US008535214B2

(12) United States Patent
Chilton, III

(10) Patent No.: US 8,535,214 B2
(45) Date of Patent: Sep. 17, 2013

(54) MODULAR WARMING THERAPY DEVICE

(75) Inventor: Robert J. Chilton, III, Quakertown, PA (US)

(73) Assignee: Draeger Medical Systems, Inc., Telford, PA (US)

( * ) Notice: Subject to any disclaimer, the term of this patent is extended or adjusted under 35 U.S.C. 154(b) by 331 days.

(21) Appl. No.: 12/740,614

(22) PCT Filed: Dec. 4, 2008

(86) PCT No.: PCT/US2008/085541
§ 371 (c)(1),
(2), (4) Date: Apr. 29, 2010

(87) PCT Pub. No.: WO2009/073789
PCT Pub. Date: Jun. 11, 2009

(65) Prior Publication Data
US 2010/0261948 A1 Oct. 14, 2010

Related U.S. Application Data

(60) Provisional application No. 61/005,520, filed on Dec. 4, 2007.

(51) Int. Cl.
*A61G 11/00* (2006.01)

(52) U.S. Cl.
USPC ..... 600/22

(58) Field of Classification Search
USPC ..... 600/21, 22; 128/897–899
See application file for complete search history.

(56) References Cited

U.S. PATENT DOCUMENTS

| | | | | |
|---|---|---|---|---|
| 4,221,211 | A * | 9/1980 | Brasch | 600/22 |
| 4,458,674 | A * | 7/1984 | Lemburg et al. | 600/22 |
| 5,325,938 | A * | 7/1994 | King | 188/19 |
| 5,335,651 | A * | 8/1994 | Foster et al. | 128/202.13 |
| 5,898,961 | A | 5/1999 | Ambach et al. | 5/600 |
| 6,073,285 | A | 6/2000 | Ambach et al. | 5/600 |
| 6,481,739 | B1 | 11/2002 | Newkirk | 280/484 |
| 2004/0236175 | A1 * | 11/2004 | Boone et al. | 600/22 |
| 2006/0163829 | A1 | 7/2006 | Livengood et al. | 280/87.021 |
| 2006/0179571 | A1 * | 8/2006 | Newkirk | 5/600 |

FOREIGN PATENT DOCUMENTS

| | | |
|---|---|---|
| EP | 1 618 862 | 1/2006 |
| WO | 94/01023 | 1/1994 |
| WO | 2004/082554 | 9/2004 |

* cited by examiner

*Primary Examiner* — Christine Matthews
*Assistant Examiner* — Joshua D Lannu
(74) *Attorney, Agent, or Firm* — DLA Piper LLP (US)

(57) ABSTRACT

Provided is a modular infant care system having a warming therapy device and a peripheral device. The warming therapy device includes a plurality of wheels and a patient support surface having an adjustable height. The peripheral device has at least one wheel and is adapted for releasably engaging the warming therapy device proximate the patient support surface. When the warming therapy device and the peripheral device are engaged to each other, the infant care system is movable as a combined unit. Also provided is a method for transporting a patient using the apparatus.

25 Claims, 26 Drawing Sheets

MODULAR WARMING THERAPY DEVICE

CROSS REFERENCE TO RELATED APPLICATIONS

This application is a §371 of International Application No. PCT/US08/85541, filed Dec. 4, 2008 (WO 2009/073789, published Jun. 11, 2009), which claims priority to U.S. Provisional Patent Application No. 61/005,520, filed Dec. 4, 2007, the entire contents of which are incorporated by reference, as if fully set forth herein.

TECHNICAL FIELD

This present disclosure relates generally to a warming therapy device (e.g. an incubator, radiant warmer, etc.) for medical patients. Specifically, the present disclosure relates to warming therapy devices with the capability to releasably engage other devices such that all engaged devices may be transported in unison.

BACKGROUND

Infant care units, such as warming therapy devices (e.g., incubators, warmers, etc.) include various systems for controlling the temperature and humidity to facilitate the development of a premature infant, are known. Also, other devices for providing medical treatment or support to infants are known. In some cases, a warming therapy device may be used in connection with other devices to treat patients within the warming therapy device would be beneficial to provide the warming therapy device with the capability to releasable engage the other devices such that all engaged devices may be transported in unison.

SUMMARY

An exemplary embodiment of the present invention comprises a modular infant care system having a warming therapy device and a peripheral device. The warming therapy device includes a plurality of wheels and a patient support surface having an adjustable height. The peripheral device has at least one wheel and is adapted for releasably engaging the warming therapy device proximate the patient support surface. When the warming therapy device and the peripheral device are engaged to each other, the infant care system is movable as a combined unit. Also provided is a method for transporting a patient using the apparatus.

A further exemplary embodiment comprises an apparatus including a first medical device having a patient support surface, a braking system, braking controls and wheels. The apparatus has a second medical device having a braking system and adapted for releasably engaging the first medical device. When the second medical device is engaged to the first medical device, the first and second medical devices are transportable as a combined unit. When the first and second medical devices are engaged, the braking control of the first medical device is operable to control the braking systems of both devices.

A further exemplary embodiment includes a method for transporting a patient. The method includes providing a medical device adapted for holding a patient in a controlled environment. The medical device has a plurality of wheels for engaging a supporting surface. Also provided is a peripheral device having at least one wheel for engaging the supporting surface. The peripheral device is adapted to releasably engage the medical device. The method further includes the steps of engaging the medical device to the peripheral device, raising the second medical device above the supporting surface and moving the medical device and peripheral device in unison.

A still further exemplary embodiment provides an apparatus having a first medical device and a second medical device. The first medical device has a patient support surface, a plurality of wheels and a first docking port located proximate the patient support surface. The second medical device has at least one wheel and a second docking port adapted for mating to the first docking port. When the second medical device is mated to the first medical device, the first and second medical devices are transportable as a combined unit.

BRIEF DESCRIPTION OF THE DRAWINGS

FIG. 20*e* shows a side elevational view of the infant care system shown in FIG. 18*a*, with the modular warming therapy device shown in a raised position.

DETAILED DESCRIPTION

The present invention relates to medical devices, such as modular warming therapy devices (i.e., incubators, radiant warmers, etc.) for use in an infant care system. In the description below, the warming therapy device is embodied as an incubator; however, the warming therapy device may be a radiant eater or any other warming therapy device used to provide a controlled environment for the treatment of infants.

Figure 1:
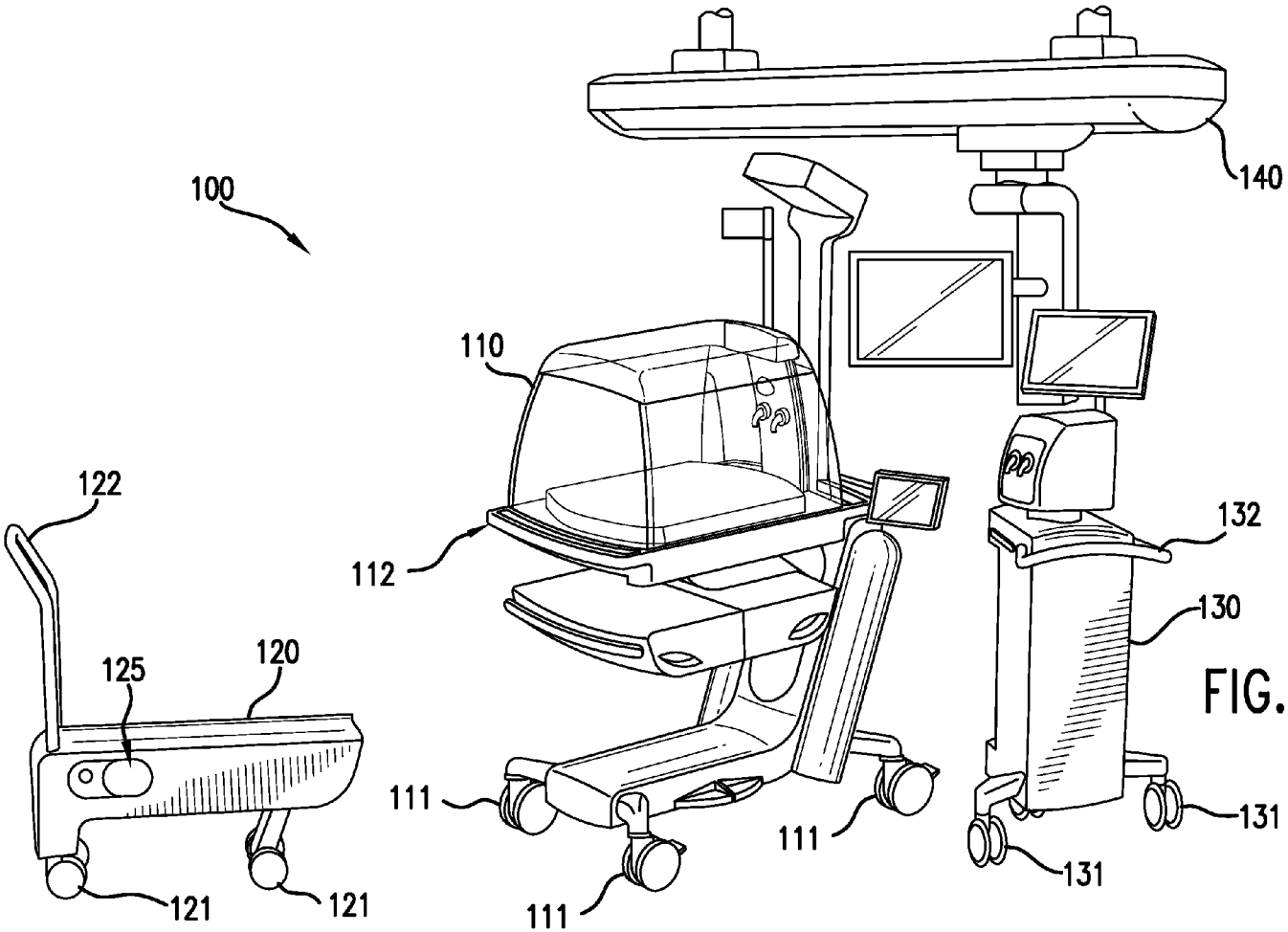
FIG. 1 is a perspective view of a first exemplary embodiment of an infant care system including a modular warming therapy device.

FIG. 1 shows an infant care system 100 according to a first exemplary embodiment of the present invention which includes a medical device, such as a warming therapy device 110, a first peripheral device 120, a second peripheral device 130, and a monitoring unit 140. The warming therapy device 110 is designed as a modular unit which may engage to one or more of the first and second peripheral devices 120, 130, as explained in detail below with reference to FIGS. 3-7. For example, the first peripheral device 120 may comprise a gas tank storage unit for storing one or more gas tanks 125 (e.g., oxygen tanks), and the second peripheral device 130 may comprise a patient monitoring unit, as shown in FIG. 1. For purposes of this application, the term "medical device" is intended to include peripheral devices such as those mentioned herein. The peripheral devices that may be used in connection with the infant care system 100, as well as others discussed herein, include resuscitation devices, a compressor for breathing or ventilation air, refrigerated storage for medication, an AED kit for a crash cart, heated storage for clothing and medication and the like, a cooling system for regulating the patient environment, a water mattress system, a video camera for phototherapy, a surgical cart with instruments etc., an anesthesia system, supplemental heating for the patient environment, a bassinet with a docked heater or any other suitable device for providing care to a patient in the warming therapy device.

Preferably, the modular warming therapy device 110, and each of the first and second peripheral devices 120, 130 each include wheels, casters, or the like 111, 121, 131 and handles 112, 122, 132 for enabling the separate units to be easily moved. As discussed below, when one or more of the first and second peripheral devices 120, 130 are coupled to the modular warming therapy device 110, one or more of these wheels 11, 121, 131 are retracted to permit the easy movement of the combined unit (See, e.g., FIG. 5).

Figure 2:
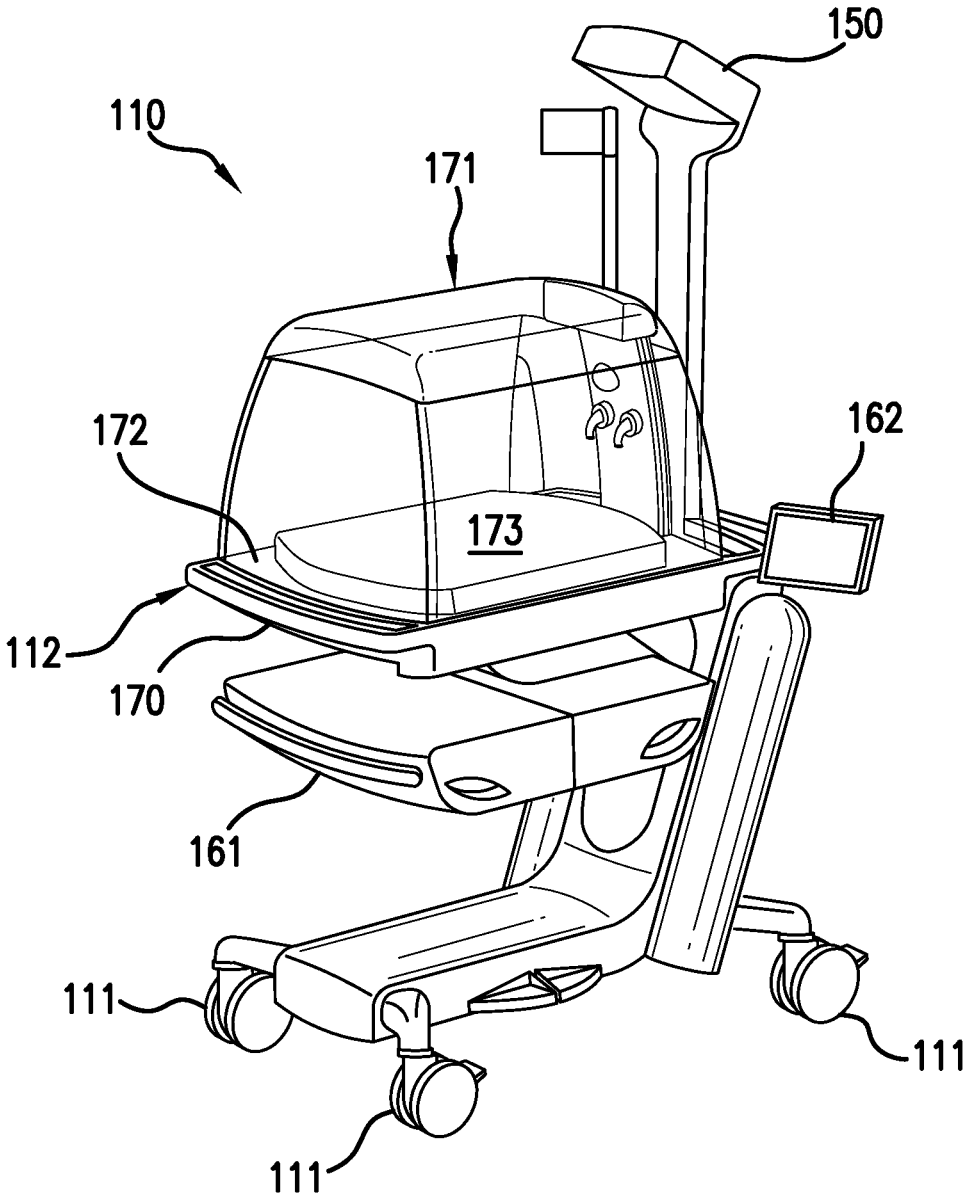
FIG. 2 is a perspective view of a modular warming therapy device of the infant care system of FIG. 1.

FIG. 2 shows the modular warming therapy device 110. The modular warming therapy device 110 includes a radiant heater head 150, a patient support assembly 160, and a mattress tray assembly 170. The mattress tray assembly 170 may include a hood 171 for covering a mattress tray 172, and associated mattress 173. The patient support assembly 160 may include a storage unit 161 for storing items for the infant patient such as diapers, blankets, wipes, etc. The patient support assembly 160 may also include a first monitor 162 for monitoring a condition of the infant patient (e.g., heart rate, etc.), or some other medical process associated with the infant patient (e.g., medical treatment).

The warming therapy device 110 may comprise a braking system and braking controls. The first and second peripheral devices 120, 130 may also comprise a braking system and or braking controls. When the warming therapy device 110 and first and second peripheral devices 120, 130 are docked together, the braking controls of the warming therapy device 110 and/or first and second peripheral devices 120, 130 are operable to control the braking systems of both the warming therapy device 110 and the first and second peripheral devices 120, 130. Linkage of the braking system and controls may be mechanical, electrical or pneumatic, such that by actuating a braking control on the warming therapy device 110 and/or first and second peripheral devices 120, 130, a caretaker is able stop or facilitate rolling movement of both the warming therapy device 110 and the first and second peripheral devices 120, 130.

Figure 3:
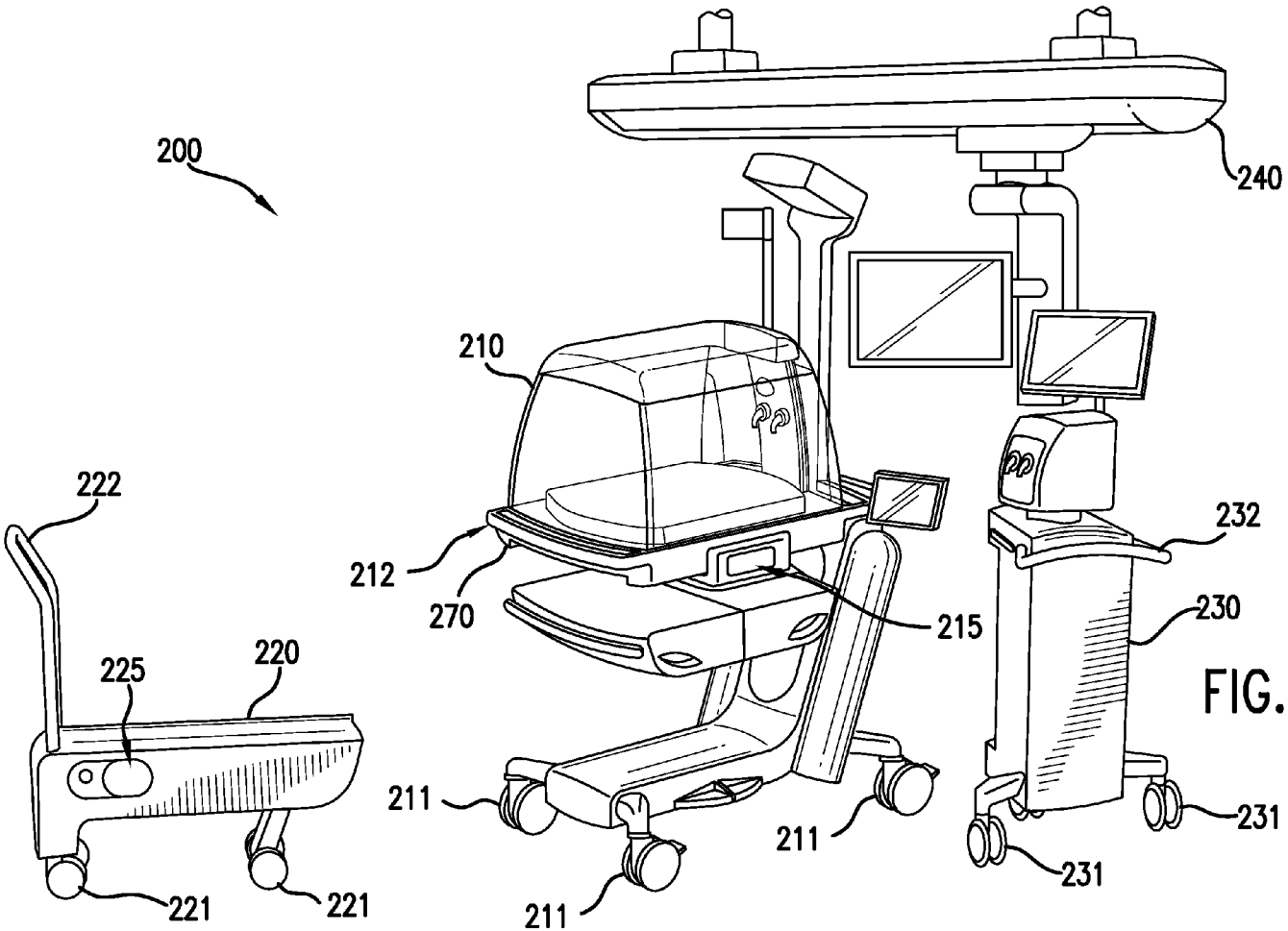
FIG. 3 is a perspective view of a second exemplary embodiment of an infant care system including a modular warming therapy device.

FIG. 3 shows an infant care system 200 according to a second exemplary embodiment of the present invention which includes a modular warming therapy device 210, a first peripheral device 220, a second peripheral device 230, and a monitoring unit 240. The infant care system 200 is similar to the infant care system 100 described above in many respects, and like reference numerals denote like elements. For example, the first peripheral device 220 may comprise a gas tank storage unit for storing one or more gas tanks 225 (e.g., oxygen tanks), and the second peripheral device 230 may comprise a patient monitoring unit.

The warming therapy device 210 is designed as a modular unit which may engage and be releasably coupled to one or more of the first and second peripheral devices 220, 230. For example, the first peripheral device 220 may comprise a gas tank storage unit for storing one or more gas tanks 221 (e.g., oxygen tanks), and the second peripheral device 230 may comprise a patient monitoring unit, as shown in FIG. 3. Preferably, the modular warming therapy device 210, and each of the first and second peripheral devices 220, 230 each include wheels, casters, or the like 211, 221, 231 and handles 212, 222, 232 for enabling the separate units to be easily moved. As discussed below, when one or more of the first and second peripheral devices 220, 230 are coupled to the modular warming therapy device 210, one or more of these heels 211, 221, 231 are retracted to permit the easy movement of the combined unit (See FIG. 5).

One difference between the warming therapy device 210 and the warming therapy device 110 discussed above is the presence of a second patient monitor 215. The second patient monitor 215 is preferably integrated into a mattress tray assembly 270 of the warming therapy device 210. The second patient monitor 215 may be used to monitor any condition of an infant patient disposed on the warming therapy device 210, such as heart rate, etc., or some other medical process associated with the infant patient (e.g., medical treatment).

Figure 4:
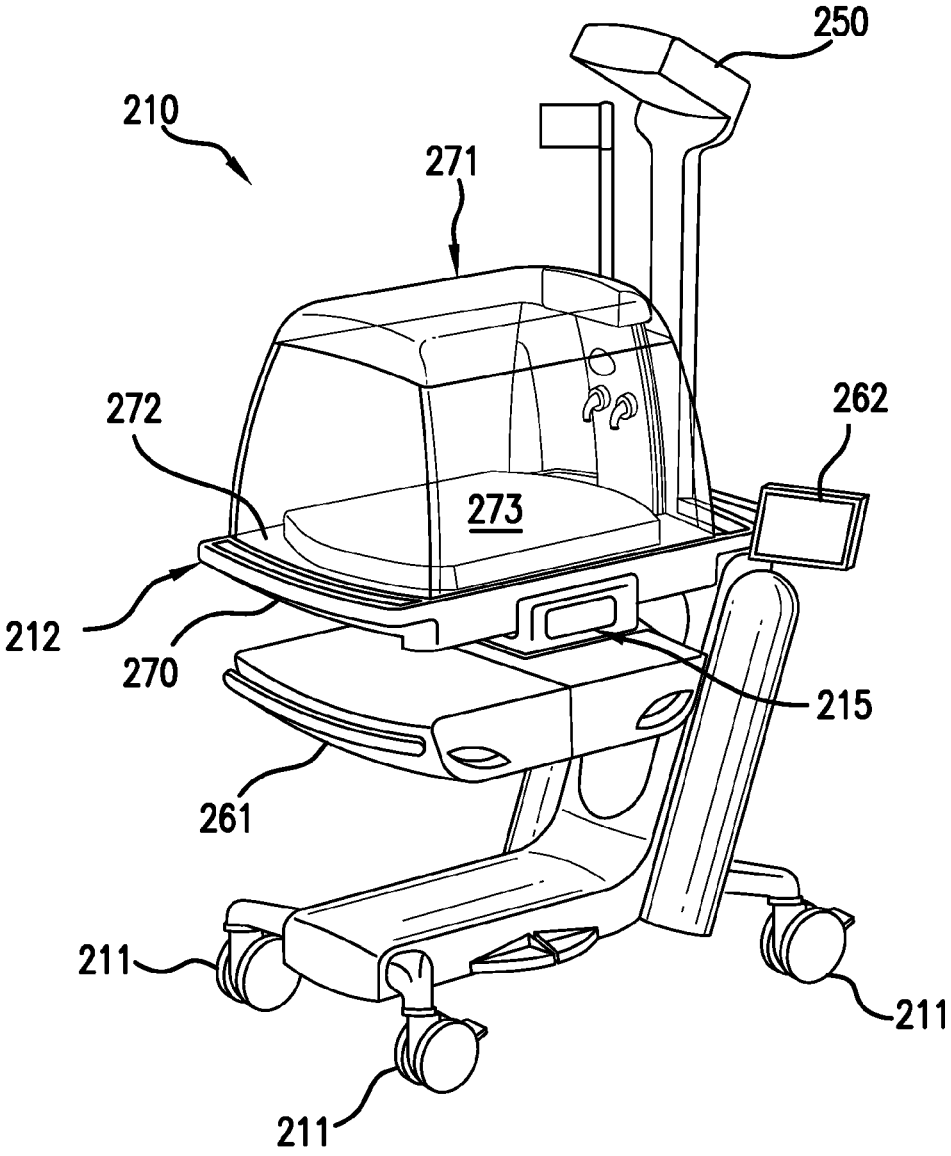
FIG. 4 is a perspective view of a modular warming therapy device of the infant care system of FIG. 3.

FIG. 4 shows the modular warming therapy device 210. The modular warming therapy device 210 includes a radiant heater head 250, a patient support assembly 260, and a mattress tray assembly 270. The mattress tray assembly 270 may include a hood 271 for covering a mattress tray 272, and associated mattress 273. The patient support assembly 260 may include a storage unit 261 for storing items for the infant patient such as diapers, blankets, wipes, etc. The patient support assembly 260 may also include a first patient monitor 262 for monitoring a condition of the infant patient (e.g., heart rate, etc.), or some other medical process associated with the infant patient. The mattress tray assembly 270 preferably includes a second patient monitor 215, as noted above, which also may be used to monitor a condition of the infant patient (e.g., heart rate, etc.), or some other medical process associated with the infant patient (e.g., medical treatment).

Figure 5:
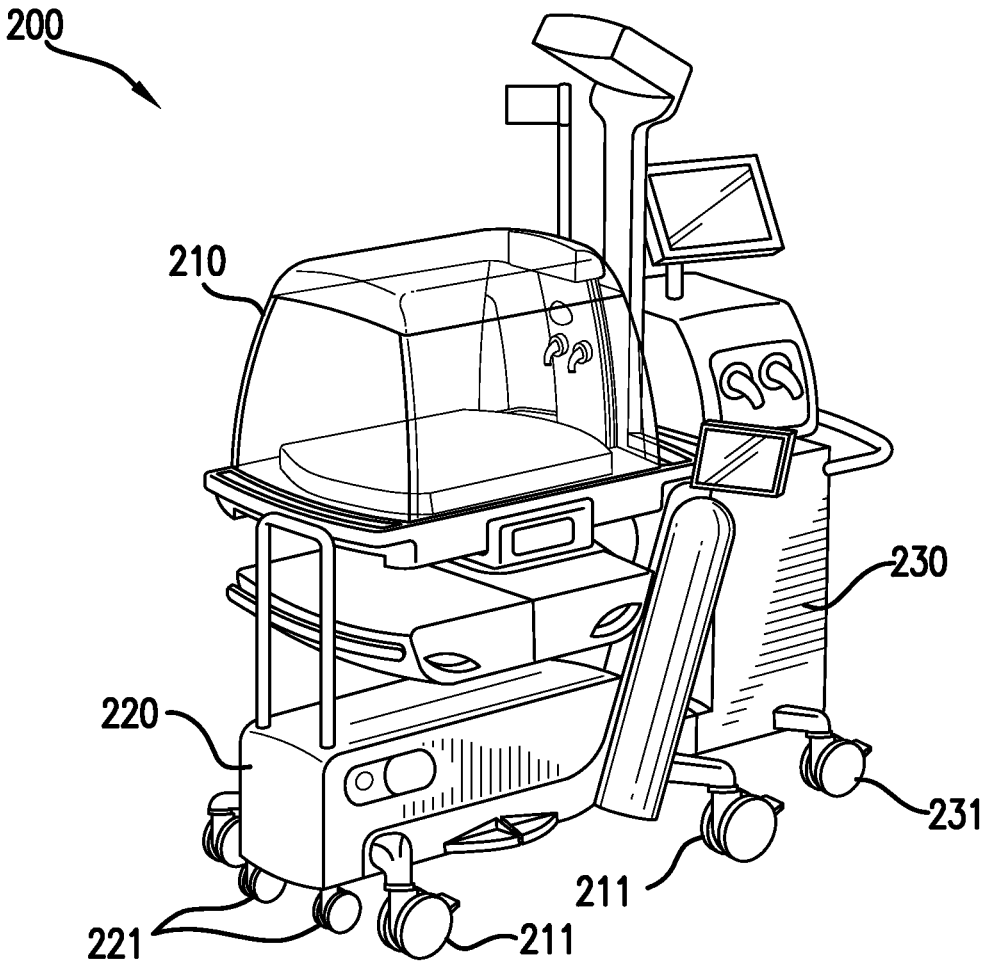
FIG. 5 is a perspective view of the modular warming therapy device of FIG. 4 with first and second peripheral devices attached thereto.

FIG. 5 shows a portion of the infant care system 200 shown in FIG. 3, including the warming therapy device 210, the first peripheral device 220, and the second peripheral device 230. The warming therapy device 210, first peripheral device 220, and second peripheral device 230 are coupled together in FIG. 5. When warming therapy device 210, first peripheral device 220, and second peripheral device 230 are coupled together in this manner, the respective wheels 221, 231 of the first peripheral device 220, and the second peripheral device 230 are raised off the ground, so that only the wheels 211 of the warming therapy device 210 are used to move the combined device. The raising of the wheels 221, 231 may be accomplished in many ways, such as providing spring-loaded or retracting wheels, by providing a means to secure the first and second peripheral devices 220, 230 to the modular warming therapy device 210 which is raised from the ground, or some combination thereof.

Figure 6:
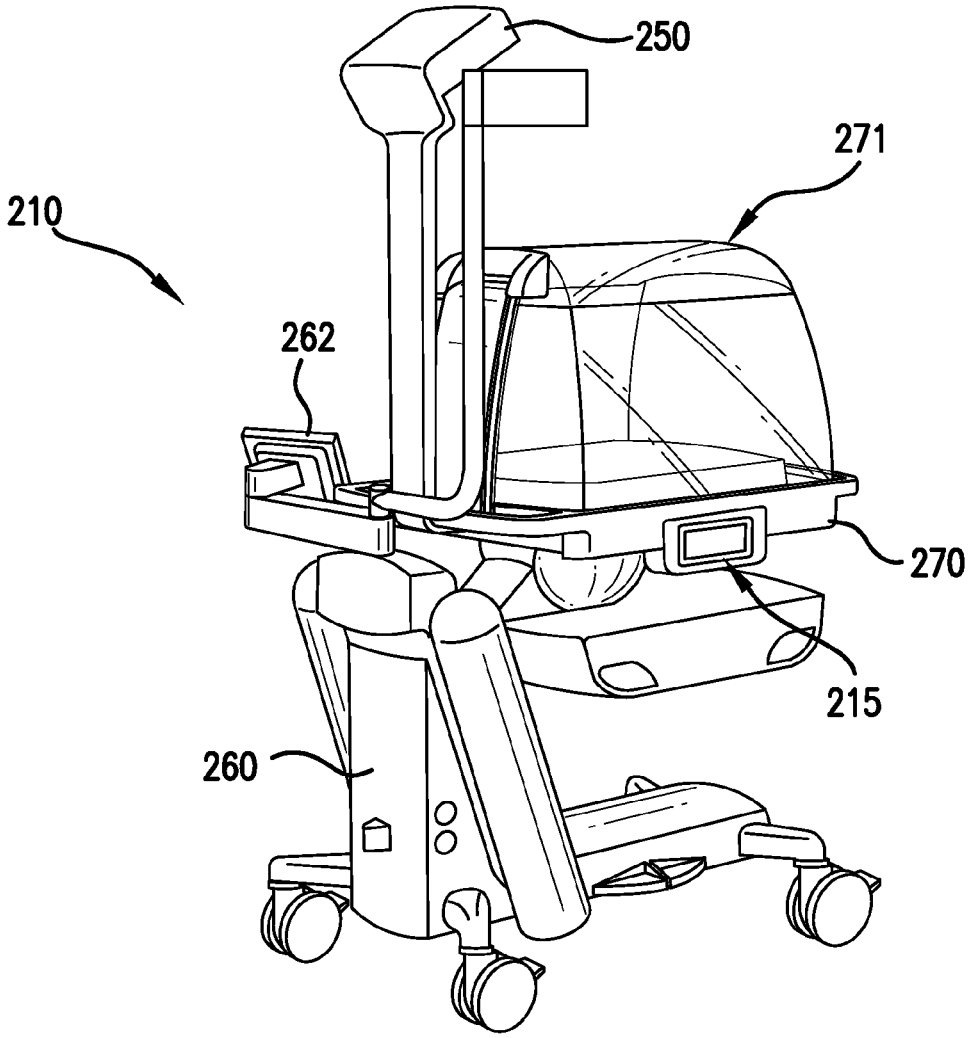
FIG. 6 is a rear perspective view of the modular warming therapy device of FIG. 4.
Figure 7:
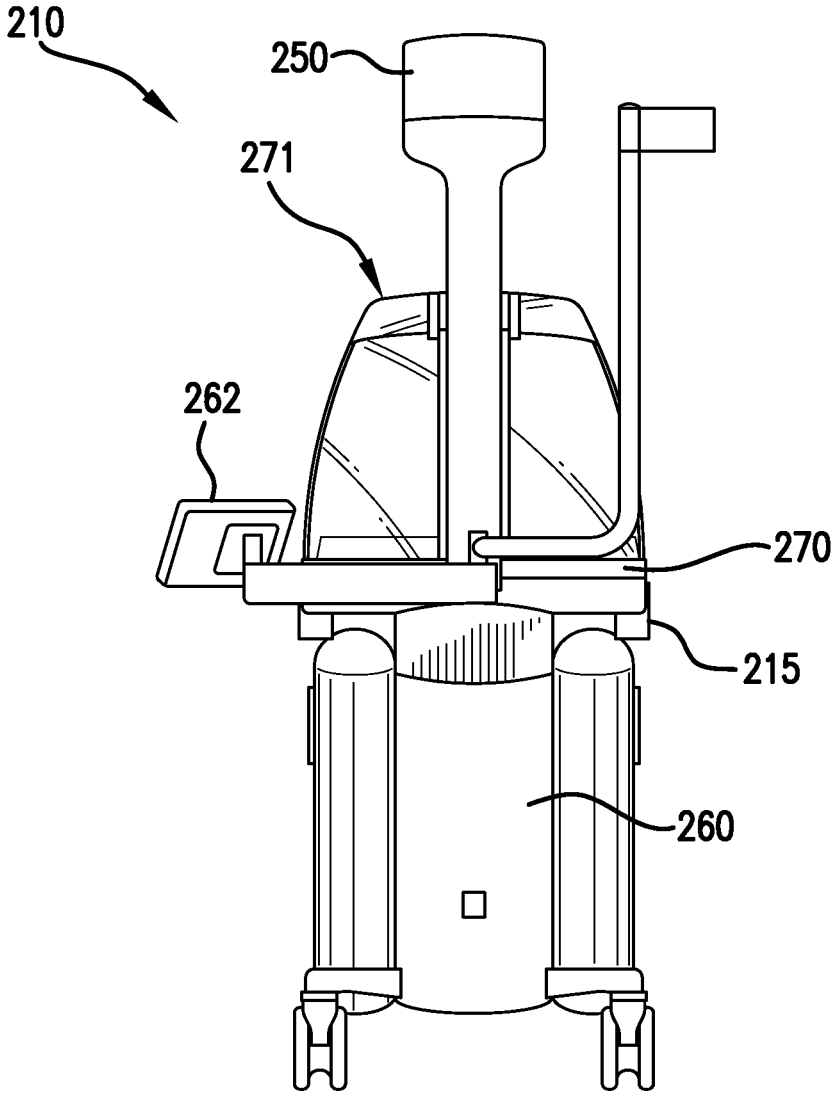
FIG. 7 is a rear view of the modular warming therapy device of FIG. 4.

FIGS. 6 and 7 show rear perspective and rear views of the warming therapy device 210, respectively. These figures show the patient support assembly 260, the mattress tray assembly 270, the hood 271, the first patient monitor 262, and the second patient monitor 215.

Figure 8:
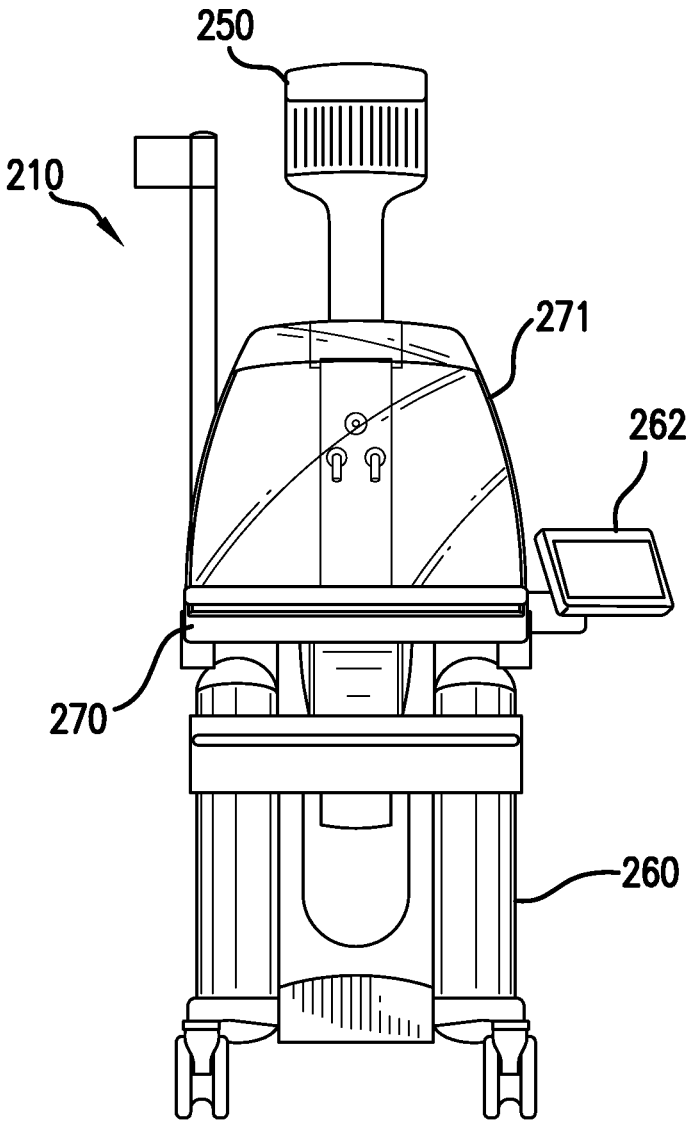
FIG. 8 shows a schematic front view of the modular warming therapy device of FIG. 4.
Figure 9:
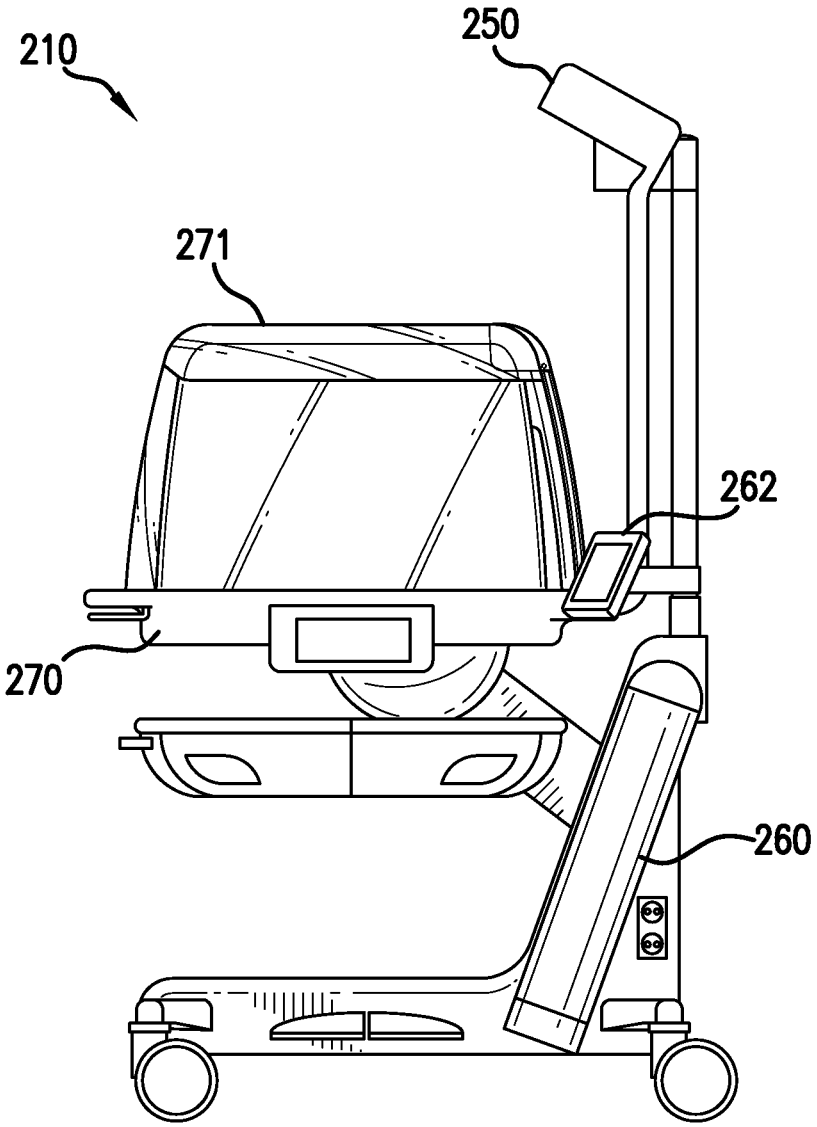
FIG. 9 shows a schematic side view of the modular warming therapy device of FIG. 4.

FIGS. 8 and 9 show front and side schematic views of the modular warming therapy device 210, respectively. These figures also show some basic dimensions for the modular warming therapy device 210, in millimeters (mm).

Figure 10:
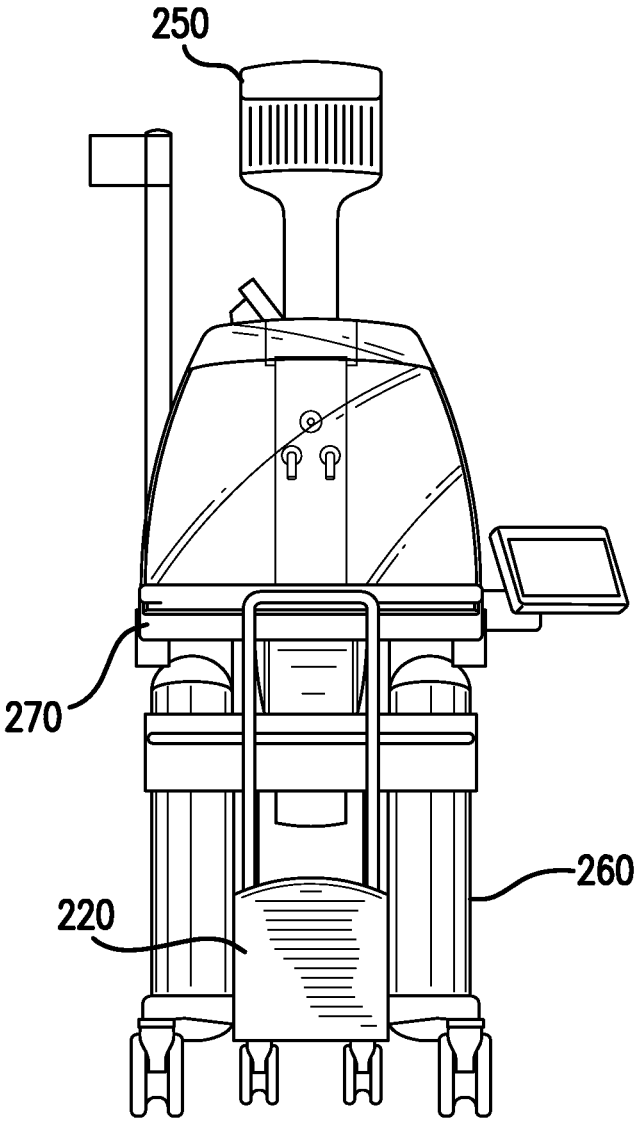
FIG. 10 shows a schematic front view of the modular warming therapy device of FIG. 5.
Figure 11:
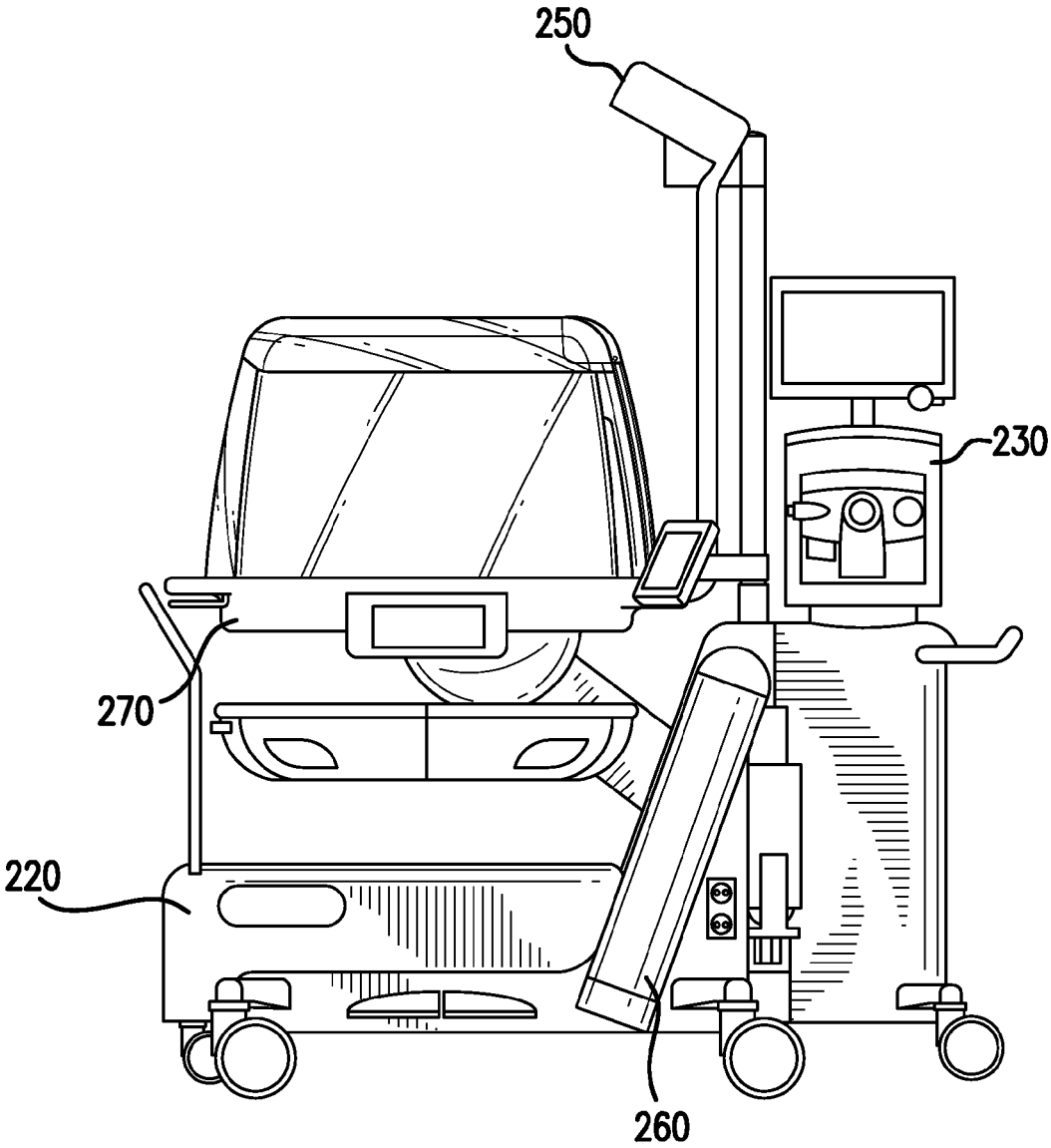
FIG. 11 shows a schematic side view of the modular warming therapy device of FIG. 5.

FIGS. 10 and 11 show front and side schematic views, respectively, of the modular warming therapy device 210, and first and second peripheral devices 220, 230. These figures also show some basic dimensions for the modular warming therapy device 210, and first and second peripheral devices 220, 230, in millimeters (mm).

Figure 12:
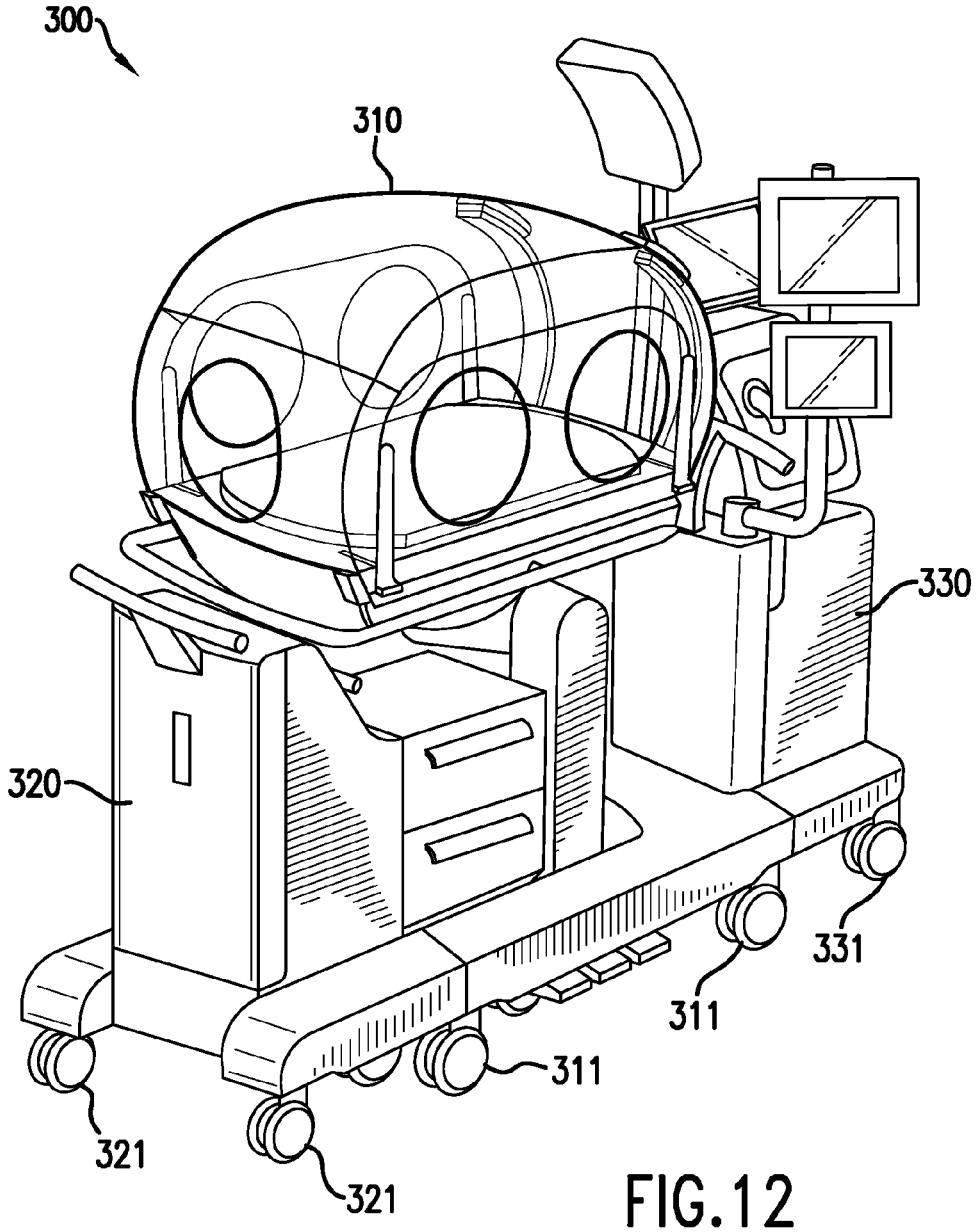
FIG. 12 is a perspective view of a third exemplary embodiment of an infant care system including a modular warming therapy device.

FIG. 12 shows an infant care system 300 according to a third exemplary embodiment of the present invention which includes a modular warming therapy device 310, a first peripheral device 320, and a second peripheral device 330. The infant care system 300 is similar to the infant care systems 100, 200 described above in many respects, and like reference numerals denote like elements. When warming therapy device 310, first peripheral device 320, and second peripheral device 330 are coupled together as shown in FIG. 12, one or more of the respective wheels 321, 331 of the first peripheral device 320, and the second peripheral device 330 are raised off the ground, so that one or more of the wheels 311 of the warming therapy device 310, and some of the wheels 321, 331 of the first and second peripheral devices 320, 330, are used to move the combined device. The raising of one or more of the wheels 321, 331 of the first and second peripheral devices 320, 330 may be accomplished in many ways, such as providing spring-loaded or retracting wheels, by providing a means to secure the first and second peripheral devices 320, 330 to the modular warming therapy device 310 which is raised from the ground, or some combination thereof. As noted above with respect to the infant care systems 100, 200, the first peripheral device 320 may comprise a gas tank storage unit for storing one or more gas tanks 325 (e.g., oxygen tanks), and the second peripheral device 330 may comprise a patient monitoring unit.

Figure 13:
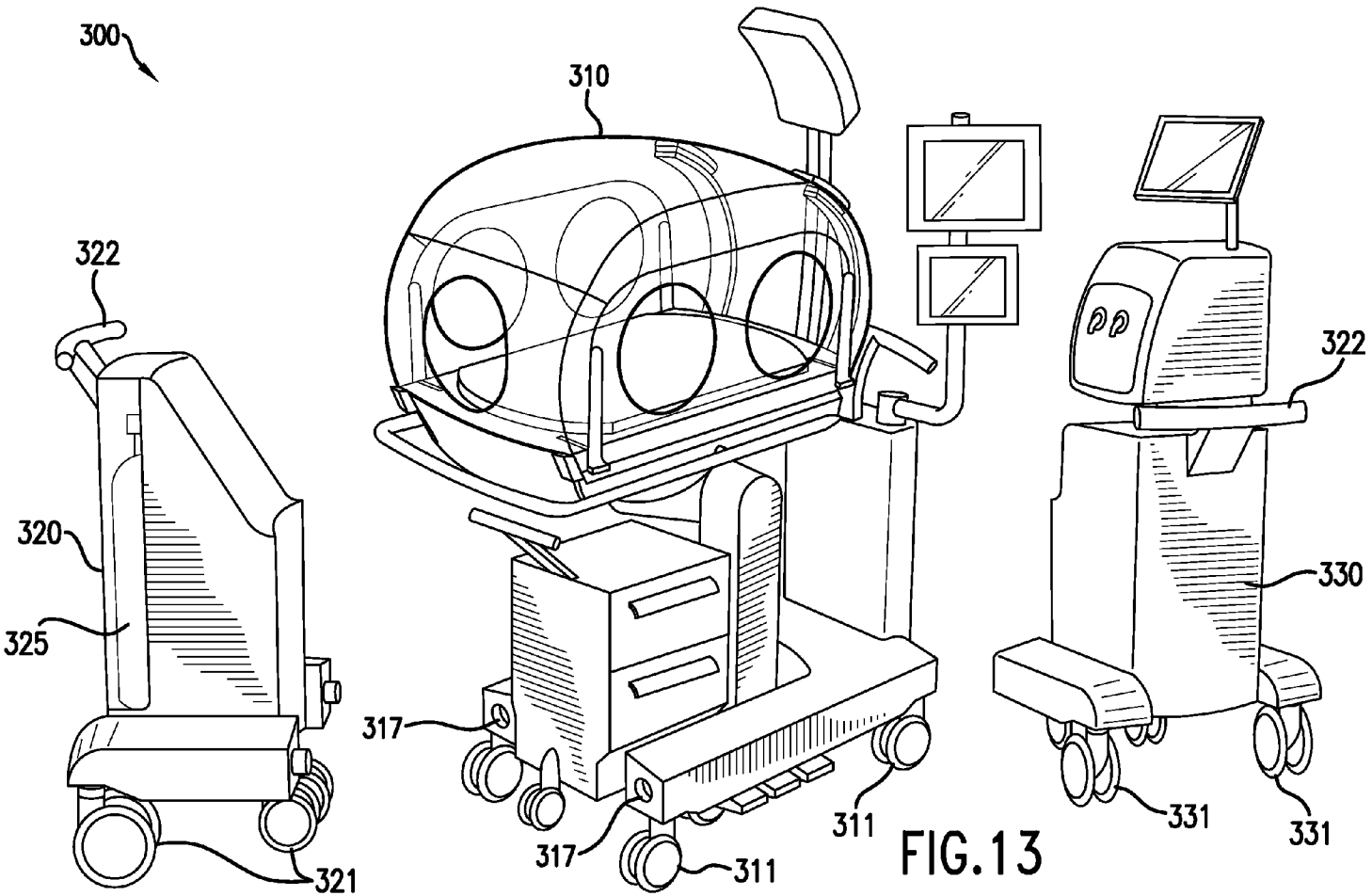
FIG. 13 is an exploded perspective view of the infant care system of FIG. 12.

FIG. 13 shows an exploded perspective view of the infant care system 300 of FIG. 12, which shows that the first peripheral device 320 may include one or more protrusions 325 which cooperate with one or more grooves 317 in the warming therapy device 310 to secure the warming therapy device to the first peripheral device. Similarly, the second peripheral device 330 may include protrusions (not shown) which cooperate with one or more grooves 318 in the warming therapy device 310 (See FIG. 15) to secure the warming therapy device to the second peripheral device.

Figure 14:
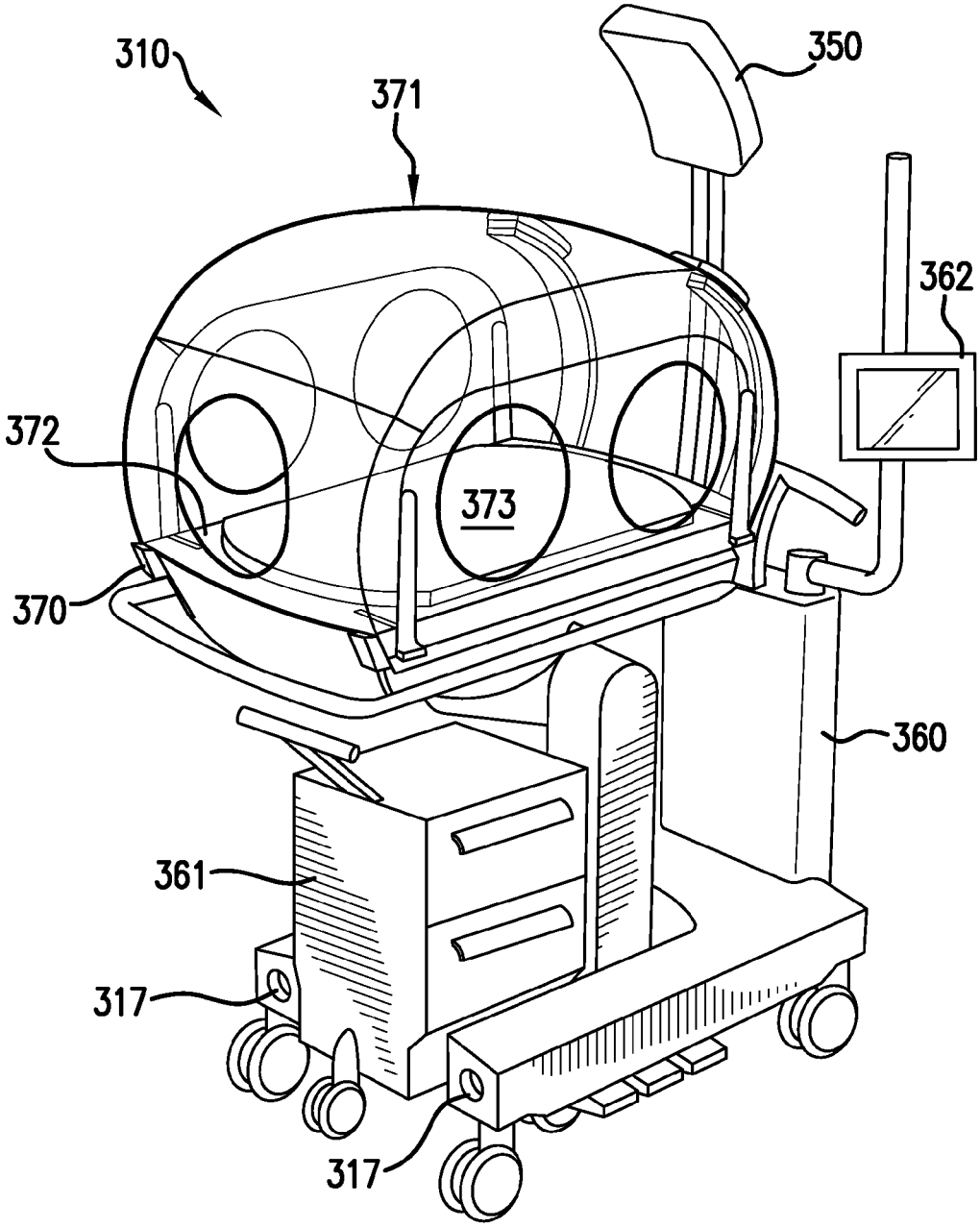
FIG. 14 is a perspective view of a modular warming therapy device of the infant care system of FIG. 12.

FIG. 14 shows the modular warming therapy device 310. The modular warming therapy device 310 includes a radiant heater head 350, a patient support assembly 360, and a mattress tray assembly 370. The mattress tray assembly 370 may include a hood 371 for covering a mattress tray 372, and associated mattress 373. The patient support assembly 360 may include a storage unit 361 for storing items for the infant patient such as diapers, blankets, wipes, etc. The patient support assembly 360 may also include a first monitor 362 for monitoring a condition of the infant patient (e.g., heart rate, etc.) or some other medical process associated with the infant patient (e.g., medical treatment).

Figure 15:
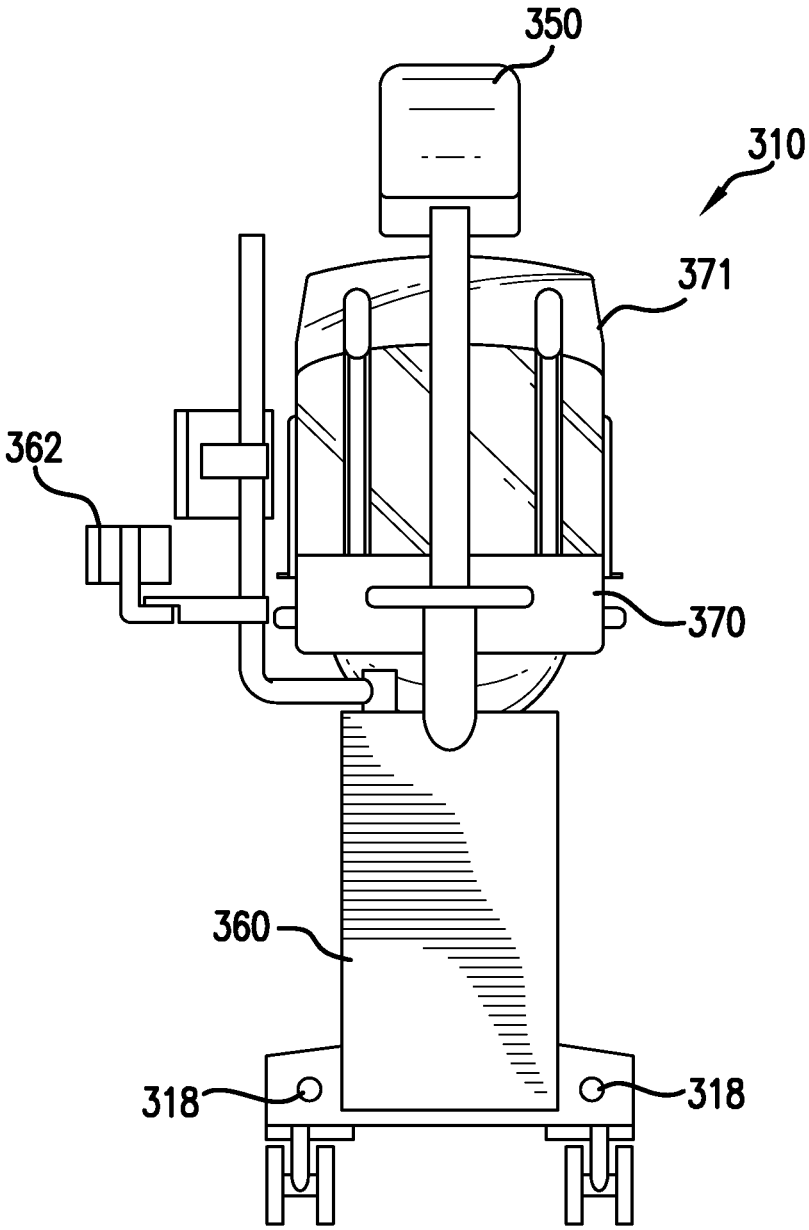
FIG. 15 is a rear view of the modular warming therapy device shown in FIG. 14.

FIG. 15 shows a rear view of the modular warming therapy device 310. This figure shows the patient support assembly 360, the mattress tray assembly 370, the hood 371, the first patient monitor 362, and the grooves 318 for securing the second peripheral device 330.

Figure 16:
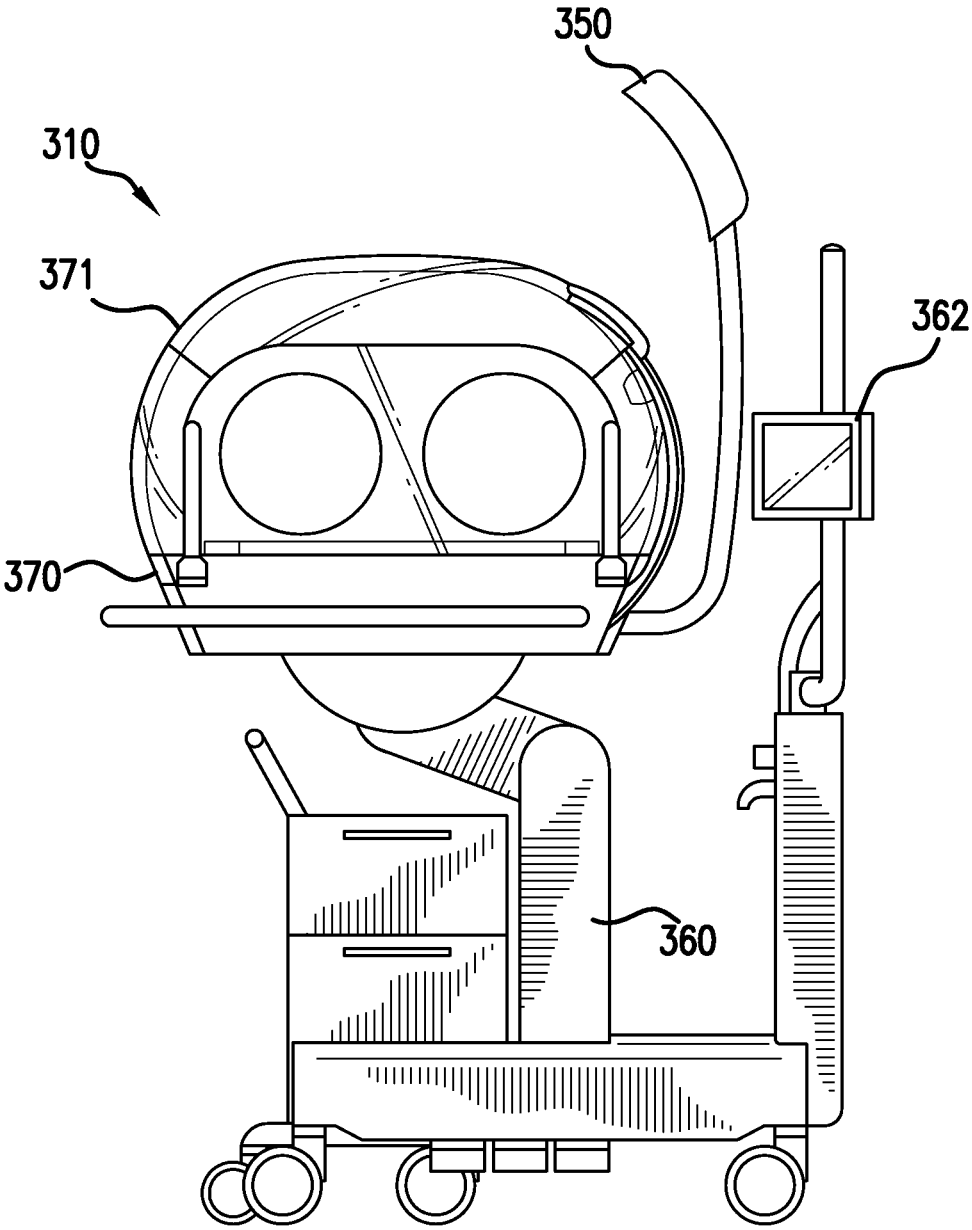
FIG. 16 shows a schematic side view of the warming therapy device of FIG. 14.
Figure 17:
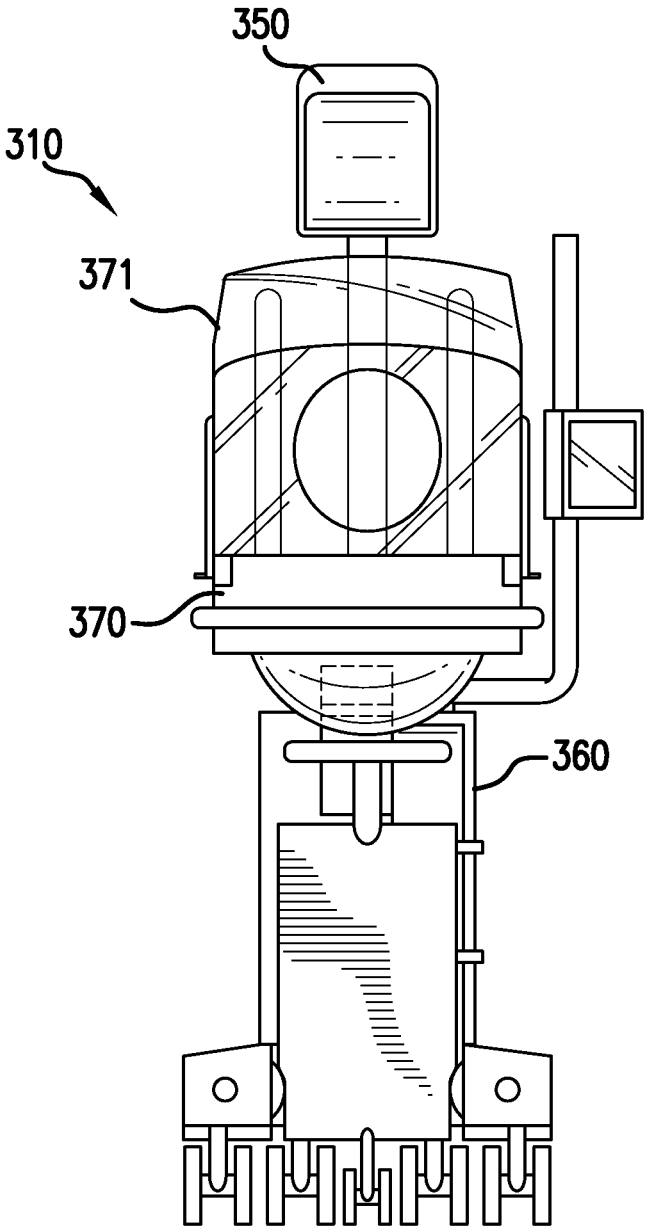
FIG. 17 shows a schematic front view of the warming therapy device of FIG. 14.

FIGS. 16 and 17 show front and side schematic views of the modular warming therapy device 310, respectively. These figures also show some basic dimensions for the modular warming therapy device 310, in millimeters (mm).

Figure 18B:
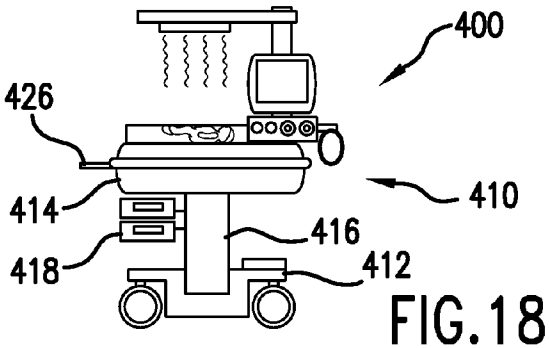
FIG. 18*b* shows a side elevational view of the modular warming therapy device shown in FIG. 18*a*.
Figure 18D:
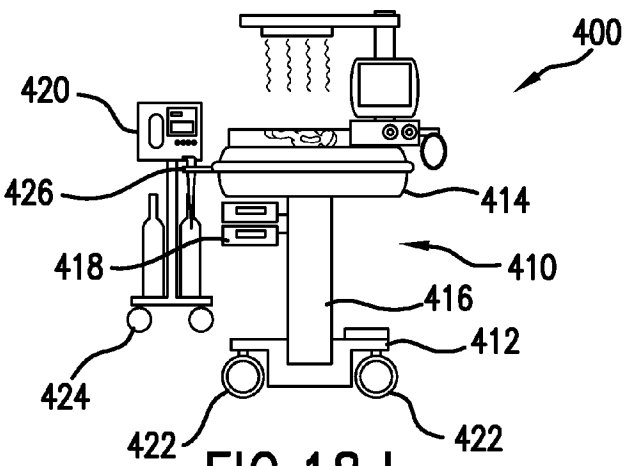
FIG. 18*d* shows a side elevational view of the infant care system shown in FIG. 18*a*, with the modular warming therapy device shown in a raised position.
Figure 18A:
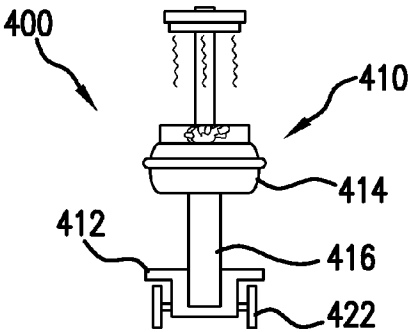
FIG. 18*a* shows a front elevational view of a fourth exemplary embodiment of an infant care system including a modular warming therapy device.
Figure 18C:
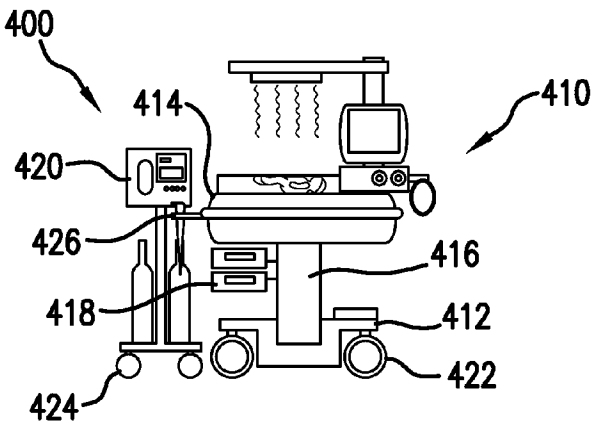
FIG. 18*c* shows a side elevational view of the infant care system shown in FIG. 18*a*, with the modular warming therapy device shown in a lowered position.

FIGS. 18*a*-18*d* show a fourth exemplary embodiment of an infant care system 400. The infant care system 400 has a warming therapy device 410, such as a radiant warmer. The warming therapy device 410 includes a cart 412 and a patient support surface 414. The cart 412 may have an adjustable spine 416 for supporting the patient support surface 414. Storage modules 418, such as drawers, may be mounted on the warming therapy device 410 at various locations. In the embodiment shown, the storage modules 418 are mounted on the spine 416. Referring to FIGS. 18*c* and 18*d* now, a peripheral device 420 may also be used in connection with and docked to the warming therapy device 410 as part of the infant care system 400. Here the peripheral device 420 engages a docking port 426 located on the warming therapy device 410. The docking port 426 is located proximate one of the longitudinal ends of the patient support surface 414. In this case, the peripheral device 420 is a ventilator with gas supply tanks mounted thereon. Both the warming therapy device 410 and the peripheral device 420 have wheels 422 and 424, respectively. When the warming therapy device 410 is in a lowered position, the wheels 422 of the warming therapy device 410 and the wheels 424 of the peripheral device 420 are both in contact with the supporting surface. However, when the patient support surface 414 is raised, the peripheral device 420 is also raised, as the result of the docking port 426 being located proximate the patient support surface 414 rather than elsewhere on the cart 412, and the wheels 424 of the peripheral device 420 are no longer in contact with the supporting surface.

Figure 19C:
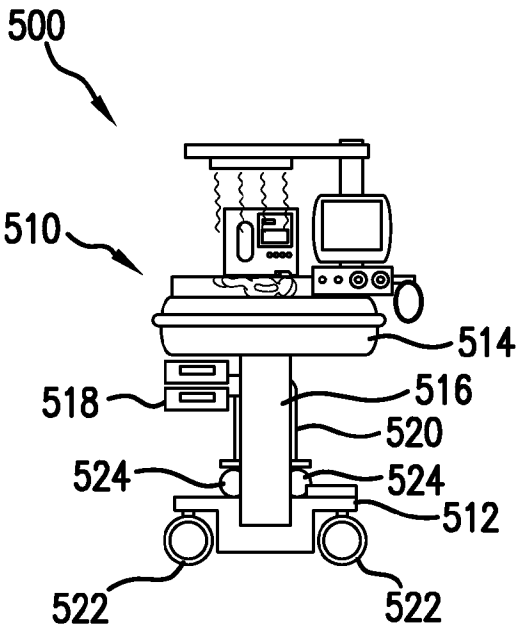
FIG. 19*c* shows a side elevational view of the infant care system shown in FIG. 19*a*, with the modular warming therapy device shown in a raised position.
Figure 19B:
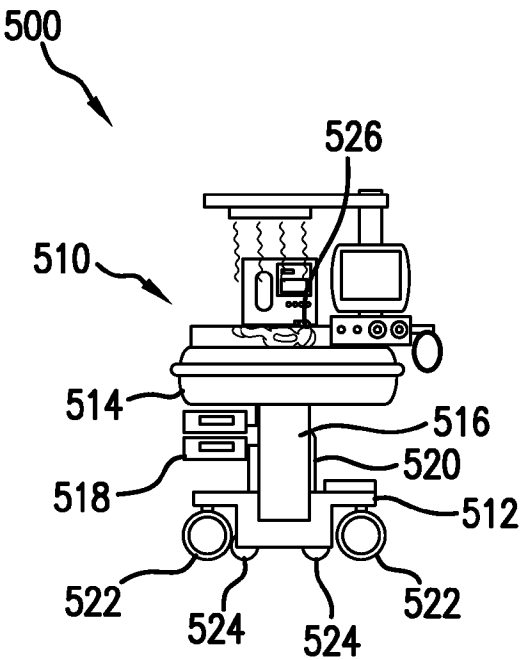
FIG. 19*b* shows a side elevational view of the infant care system shown in FIG. 19*a*, with the modular warming therapy device shown in a lowered position.
Figure 19A:
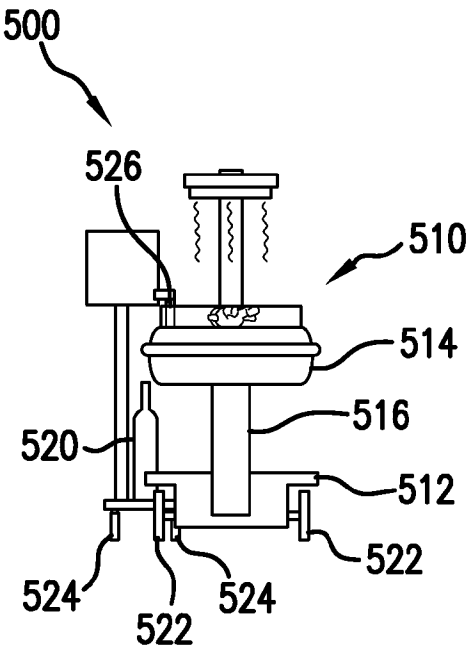
FIG. 19*a* shows a front elevational view of a fifth exemplary embodiment of an infant care system including a modular warming therapy device.

FIGS. 19*a*-19*c* show a fifth exemplary embodiment of an infant care system 500. The fifth exemplary embodiment is similar to the fourth exemplary embodiment, with the exception of the location of docking of a peripheral device to the warming therapy device. The infant care system 500 has a warming therapy device 510, such as a radiant warmer. The warming therapy device 510 includes a cart 512 and a patient support surface 514. The cart 512 may have an adjustable spine 516 for supporting the patient support surface 514. Storage modules 518, such as drawers, may be mounted on the warming therapy device 510 at various locations. In the embodiment shown, the storage modules 518 are mounted on the spine 516. Referring to FIGS. 19*b* and 19*c* now, a peripheral device 520 may also be used in connection with and docked to the warming therapy device 510 as part of the infant care system 500. Here the warming therapy device 510 engages a docking port 526 located on the upper portion of the peripheral device 520. The docking port 526 engages the warming therapy device 510 in the center of the patient support surface 514. In this case, the peripheral device 520 is a ventilator with gas supply tanks mounted thereon. Both the warming therapy device 510 and the peripheral device 520 have wheels 522 and 524, respectively. When the warming therapy device 510 is in a lowered position, the wheels 522 of the warming therapy device 510 and the wheels 524 of the peripheral device 520 are both in contact with the supporting surface. However, when the patient support surface 514 is raised, the peripheral device 520 is also raised, as the result of the docking port 526 engaging the warming therapy device 510 proximate the patient support surface 514 rather than elsewhere on the cart 512, and the wheels 524 of the peripheral device 520 are no longer in contact with the supporting surface.

Figure 20A:
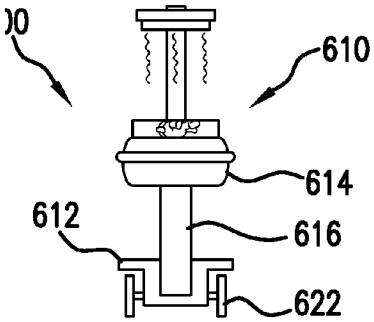
FIG. 20*a* shows a front elevational view of a sixth exemplary embodiment of an infant care system including a modular warming therapy device and a peripheral device.
Figure 20B:
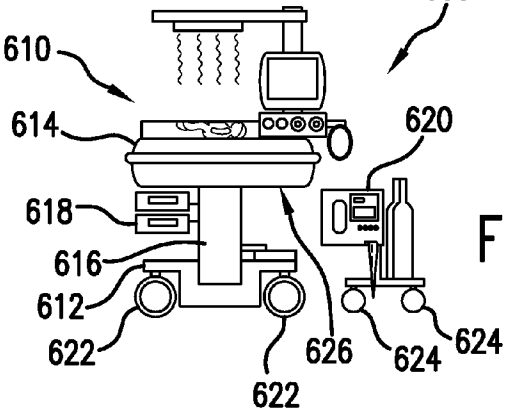
FIG. 20*b* shows a front elevational view of the infant care system shown in FIG. 20*a* with the peripheral device docked in the modular warming therapy device.
Figure 20C:
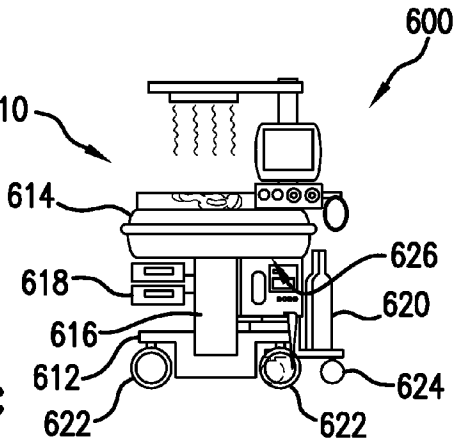
FIG. 20*c* shows a side elevational view of the modular warming therapy device shown in FIG. 20*a*.
Figure 20D:
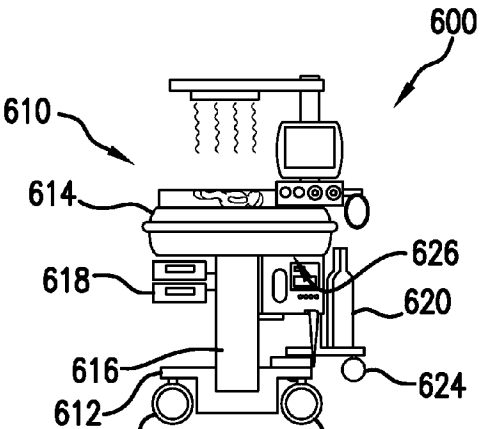
FIG. 20*d* shows a side elevational view of the infant care system shown in FIG. 20*a*, with the modular warming therapy device shown in a lowered position.
Figure 21A:
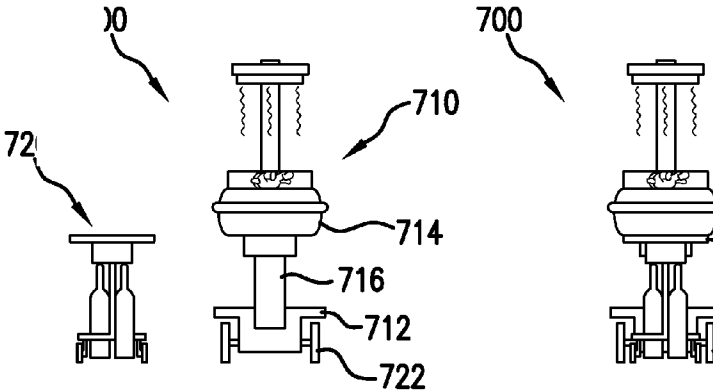
FIG. 21*a* shows a front elevational view of a seventh exemplary embodiment of an infant care system including a modular warming therapy device.
Figure 21B:
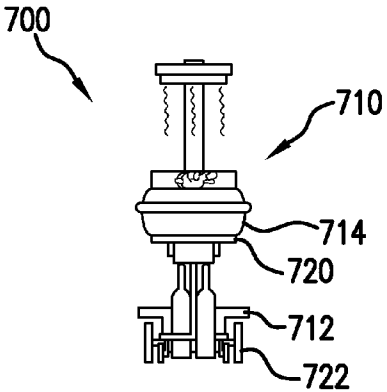
FIG. 21*b* shows a side elevational view of the modular warming therapy device shown in FIG. 18*a*.
Figure 21C:
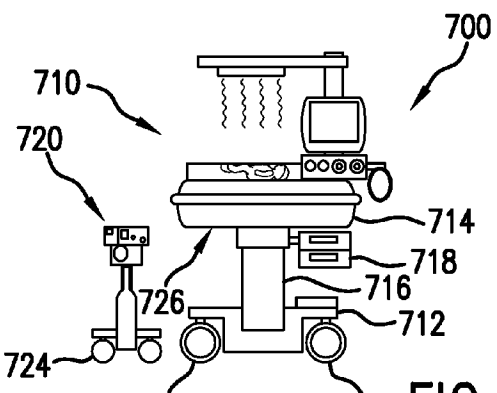
FIG. 21*c* shows a side elevational view of the infant care system shown in FIG. 18*a*, with the modular warming therapy device shown in a lowered position.
Figure 21D:
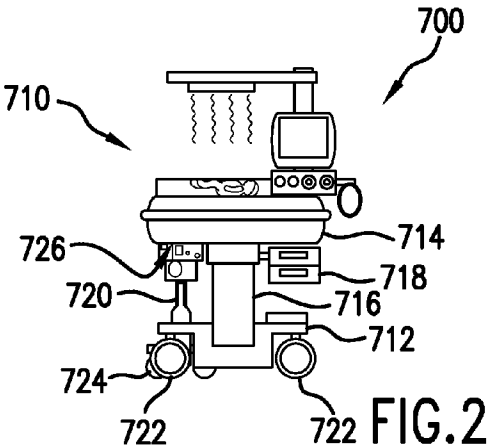
FIG. 21*d* shows a side elevational view of the infant care system shown in FIG. 18, with the modular warming therapy device shown in a raised position.
Figure 21E:
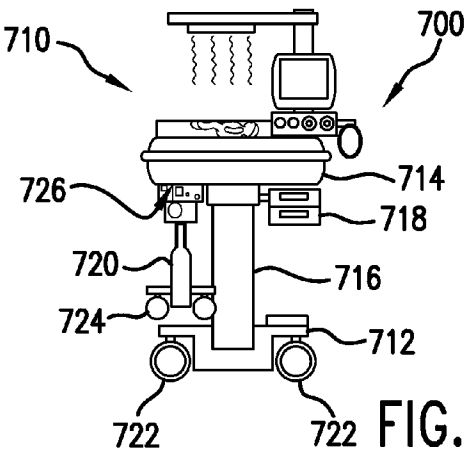

FIGS. 20*a*-20*d* show a sixth exemplary embodiment of an infant care system 600. The sixth exemplary embodiment is similar to the fourth and fifth exemplary embodiments 400, 500, with the exception of the location of docking of a peripheral device to the warming therapy device. The infant care system 600 has a warming therapy device 610, such as a radiant warmer. The warming therapy device 610 includes a cart 612 and a patient support surface 614. The cart 612 may have an adjustable spine 616 for supporting the patient support surface 614. Storage modules 618, such as drawers, may be mounted on the warming therapy device 610 at various locations. In the embodiment shown, the storage modules 618 are mounted on the lower side of the patient support surface 614. Referring to FIGS. 20*d* and 20*e* now, a peripheral device 620 may also be used in connection with and docked to the warming therapy device 610 as part of the infant care system 600. Here the warming therapy device 610 is docked to a docking port 626 on the underside of the patient support surface 614. The docking port 626 engages the warming therapy device 610 in the center of the patient support surface 614. In this case, the peripheral device 620 is a ventilator with gas supply tanks mounted thereon. Both the warming therapy device 610 and the peripheral device 620 have wheels 622 and 624, respectively. When the warming therapy device 610 is in a lowered position, the wheels 622 of the warming therapy device 610 and the wheels 624 of the peripheral device 620 are both in contact with the supporting surface. However, when the patient support surface 614 is raised, the peripheral device 620 is also raised, as the result of the docking port 626 engaging the warming therapy device 610 proximate the patient support surface 614 rather than elsewhere on the cart 612, and the wheels 624 of the peripheral device 620 are no longer in contact with the supporting surface.

FIGS. 21*a*-21*e* show a seventh exemplary embodiment of an infant care system 700. The seventh exemplary embodiment is similar to the fourth, fifth and sixth exemplary embodiments 400, 500, 600, with the exception of the location of docking of a peripheral device to the warming therapy device. The infant care system 700 has a warming therapy device 710, such as a radiant warmer. The warming therapy device 710 includes a cart 712 and a patient support surface 714. The cart 712 may have an adjustable spine 716 for supporting the patient support surface 714. Storage modules 718, such as drawers, may be mounted on the warming therapy device 710 at various locations. In the embodiment shown, the storage modules 718 are mounted on the lower side of the patient support surface 714. Referring to FIGS. 20*d* and 20*e* now, a peripheral device 720 may also be used in connection with and docked to the warming therapy device 710 as part of the infant care system 700. Here the warming therapy device 710 is docked to a docking port 726 on the underside of the patient support surface 714. The docking port 726 engages the warming therapy device 710 in the center of the patient support surface 714. In this case, the peripheral device 720 is a ventilator with gas supply tanks mounted thereon. Both the warming therapy device 710 and the peripheral device 720 have wheels 722 and 724, respectively. When the warming therapy device 710 is in a lowered position, the wheels 722 of the warming therapy device 710 and the wheels 724 of the peripheral device 720 are both in contact with the supporting surface. However, when the patient support surface 714 is raised, the peripheral device 720 is also raised, as the result of the docking port 726 engaging the warming therapy device 710 proximate the patient support surface 714 rather than elsewhere on the cart 712, and the wheels 724 of the peripheral device 720 are no longer in contact with the supporting surface.

Figures 22A, 22B, 22C, 22D:
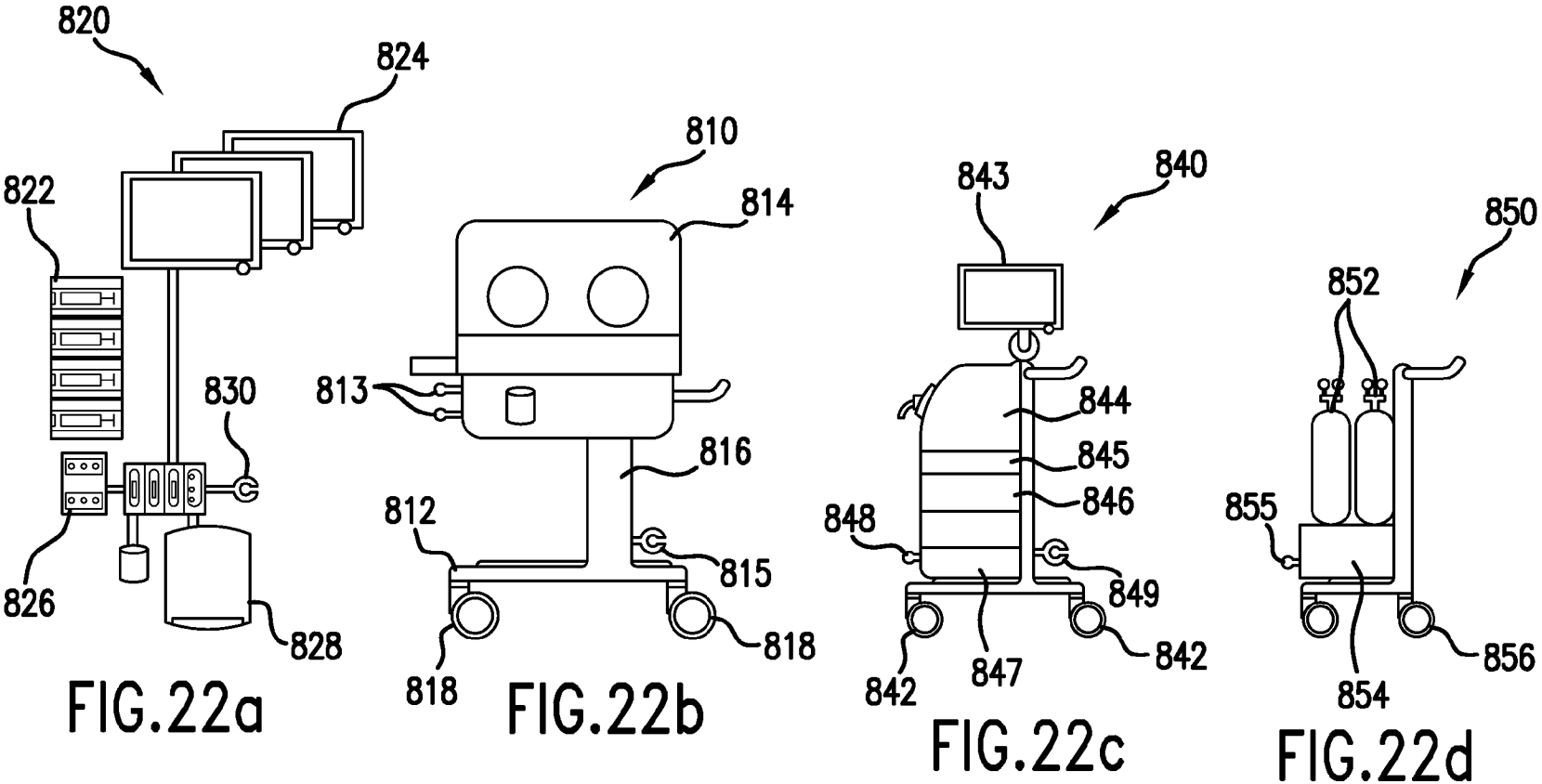
FIG. 22*a* shows a monitor and frame system for use in connection with an eighth exemplary embodiment of man infant care system.
FIG. 22*b* shows a cart and warming therapy device for use in connection with an eighth exemplary embodiment of an infant care system.
FIG. 22*c* shows a ventilator cart for use in connection with an eighth exemplary embodiment of an infant care system.
FIG. 22*d* shows a supply cart with ventilator gas tanks and a battery for use in connection with an eighth exemplary embodiment of an infant care system.
Figure 23A:
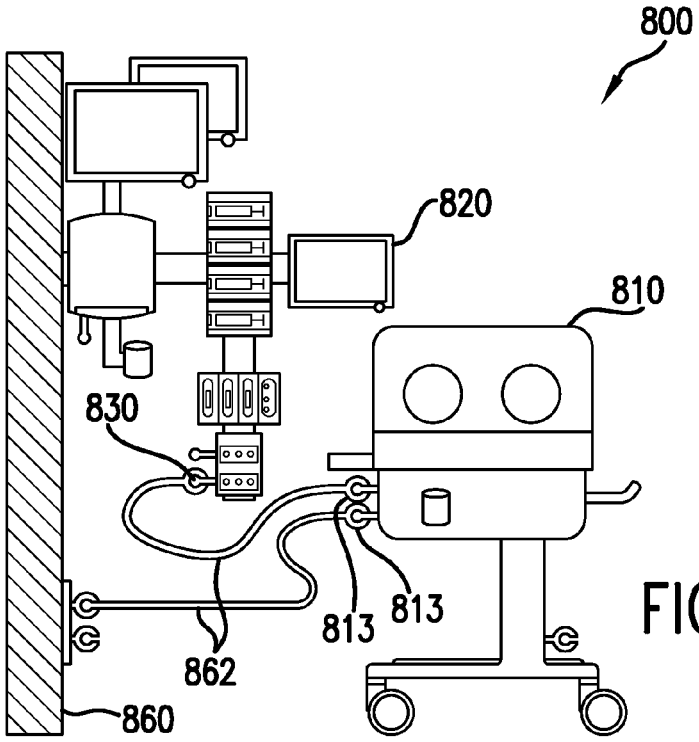
FIG. 23*a* shows an eighth exemplary embodiment of an infant care system with a wall mounted monitor and frame system.

FIG. 22*a* shows a monitor and frame system 820 for use in connection with an eighth exemplary embodiment of an infant care system 800 (shown in FIG. 23*a*). The monitor and frame system 820 includes monitors 822 for monitoring various conditions of a patient and displays 824 for visually displaying said conditions. The monitor and frame system 820 may also include a hub 826 for connecting the monitors 822 and displays 824 together, a power supply 828 and a docking connection 830 for engaging a warming therapy device 810 (shown in FIG. 22*b*) or some other medical device.

FIG. 22*b* shows a cart 812 and warming therapy device 810 for use in connection with an eighth exemplary embodiment of an infant care system 800. The cart 812 has a patient chamber 814, a spine 816 and wheels 818. The cart 812 also has male and female docking connections 813, 815 for mating with docking connections, such as the docking connection 830 on the monitor and frame system 820.

FIG. 22*c* shows a ventilator cart 840 for use in connection with an eighth exemplary embodiment of an infant care system 800. The ventilator cart has wheels 842, a monitor 843, a ventilator 844 for providing ventilation gas to a patient, a humidification device 845 for humidifying the ventilation air, a power supply 846 and a docking module 847, including male and female docking connections 848, 849 for engaging a warming therapy device 810 or other peripheral device.

FIG. 22*d* shows a supply cart 850 with ventilator gas tanks 852, such as oxygen tanks or tanks or tanks with other gasses, and a battery 854 for use in connection with an eighth exemplary embodiment of an infant care system 800. The supply cart has a docking connection 855, which may mate with the docking connection 849 on the ventilator cart 840. When the supply cart 850 and the ventilator cart 840 are docked together, along with the warming therapy device 810, they can act as a self-contained, transportable system for providing ventilation treatment to a patient residing within the warming therapy device 810.

Figure 23B:
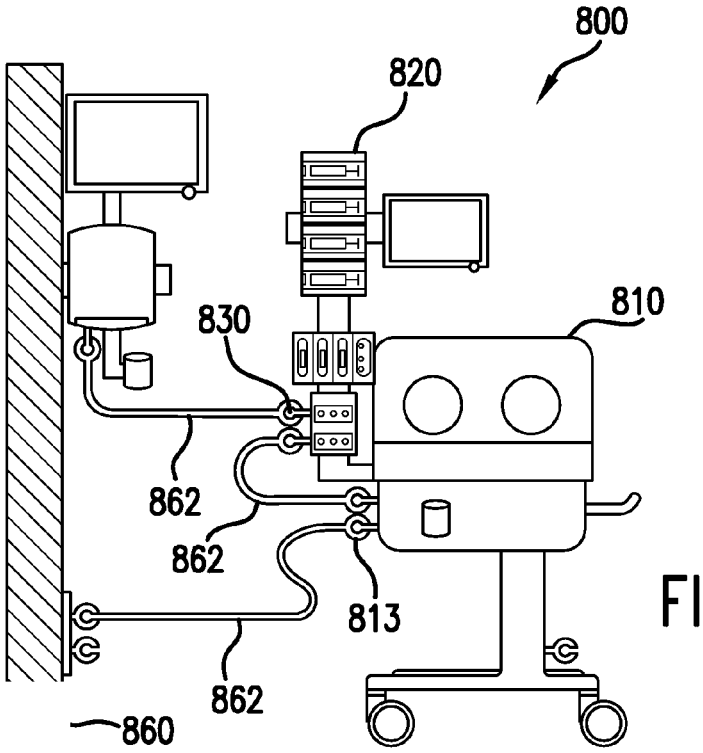
FIG. 23*b* shows the eighth exemplary embodiment of an infant care system with a monitor and frame system transportably mounted on the warming therapy device.
Figure 23C:
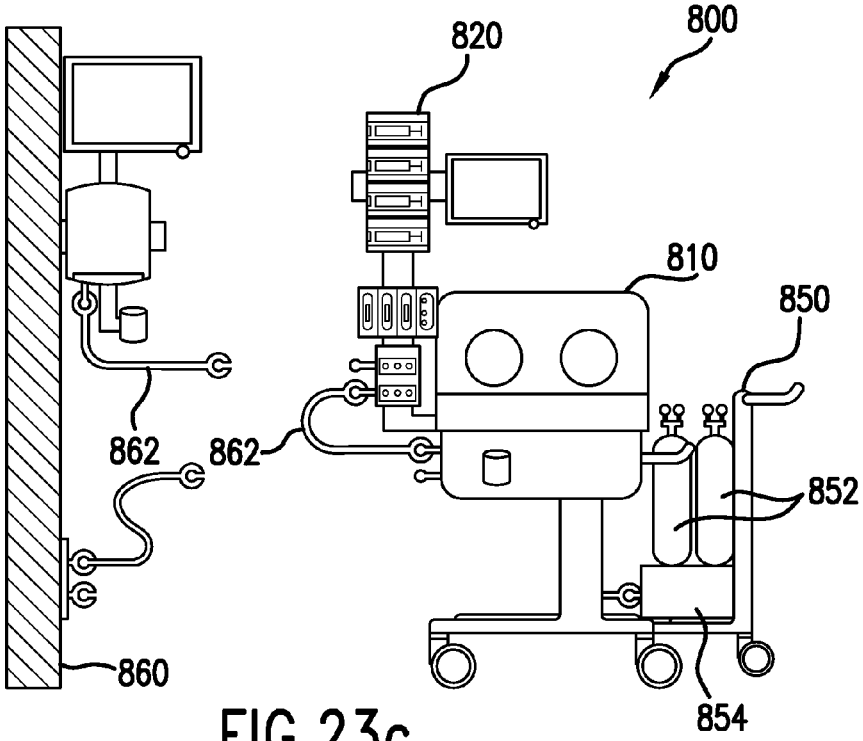
FIG. 23*c* shows the eighth exemplary embodiment of an infant care system with a monitor and frame system and ventilation gas tanks transportably mounted on the warming therapy device.

Referring now to FIGS. 23*a*-23*c*, there is shown an eighth exemplary embodiment of an infant care system 800. The infant care system is used in connection with a monitor and frame system 820 and a supply cart 850.

FIG. 23*a* shows the monitor and frame system 820 being mounted on a wall 860, such as in a hospital environment. The monitor and frame system 820 may be mounted on the wall 860, with the warming therapy device 810 docked thereto, such as by a docking cable 862. The docking cable 862 may comprise monitoring leads, power wires, gas supply tubes or any other feed lines or wires that may be used in connection with operation of the warming therapy device 810. The docking cable 862 is also mutable to the docking connections 830, 813, such as on the warming therapy device 810 and the monitor and frame system 820. Here, the warming therapy device 810 is docked, via docking cables 862 to both the wall 860 and the monitor and frame device 810.

FIG. 23*b* shows the eighth exemplary embodiment of an infant care system 800 with the monitor and frame system 820 transportably engaged to and mounted on the warming therapy device 810. Here, the monitor and frame device 820 is linked to the wall 860, via a docking cable 862. The warming therapy device 810 is docked to the wall 860 and monitor and frame device 820 via docking cables 862. The docking cables that dock to the wall 860 may supply power, ventilation gasses or provide the transmission of data to and from the warming therapy device 810 and monitor and frame device 820.

FIG. 23*c* shows the eighth exemplary embodiment of an infant care system 800 with a monitor and frame system 820 and supply cart 850 docked to the warming therapy device 810. Here, the warming therapy device 810 is entirely disengaged by the wall 860, power is supplied by a batter 854 on the supply cart 850 and ventilation gas is supplied by the gas tanks 852 on the supply cart 850.

The warming therapy device 810 may comprise a braking system and braking controls. The supply cart 850 may also comprise a braking system. When the warming therapy device 810 and supply cart 850 are docked together, the braking controls of the warming therapy device 810 are operable to control the braking systems of both the warming therapy device 810 and the supply cart 850. Linkage of the braking system and controls may be mechanical, electrical or pneumatic, such that by actuating a braking control on the warming therapy device 810, a caretaker is able stop or facilitate rolling movement of both the warming therapy device 810 and the supply cart 850. The braking system may be linked using the docking connections on the first and second peripheral devices 120, 130.

Figure 24A:
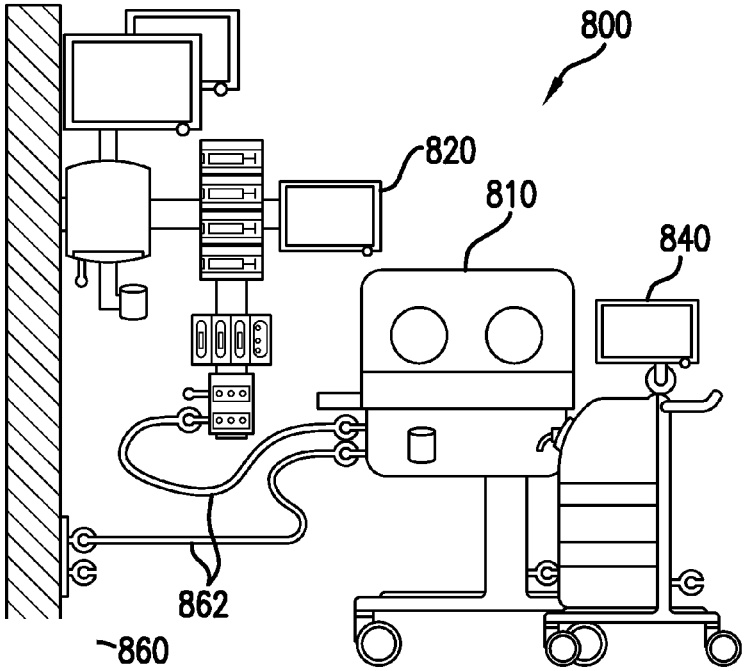
FIG. 24*a* shows the eighth exemplary embodiment of an infant care system with a wall mounted monitor and frame system and a ventilator cart mounted to a warming therapy device.
Figure 24B:
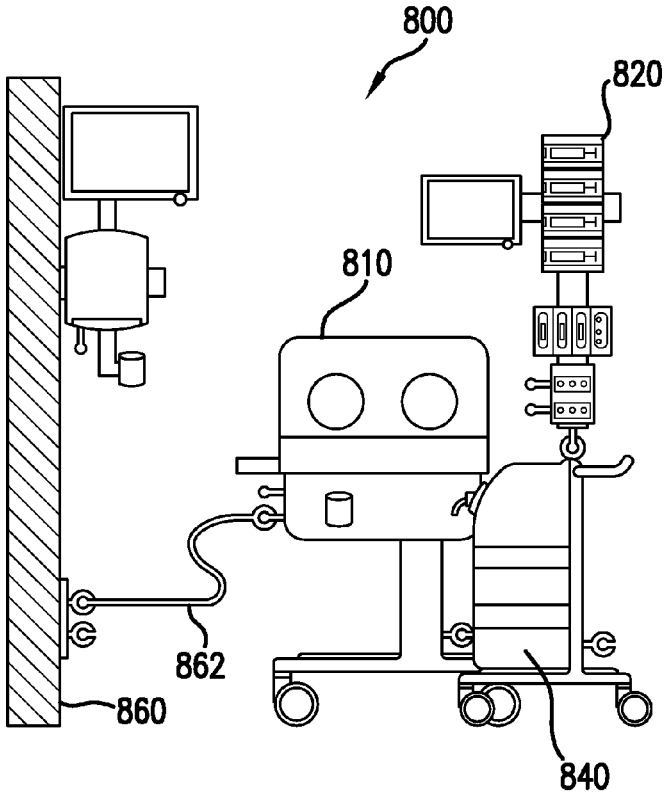
FIG. 24*b* shows the eighth exemplary embodiment of an infant care system with a monitor and frame system and ventilator cart transportably mounted on the warming therapy device.
Figure 24C:
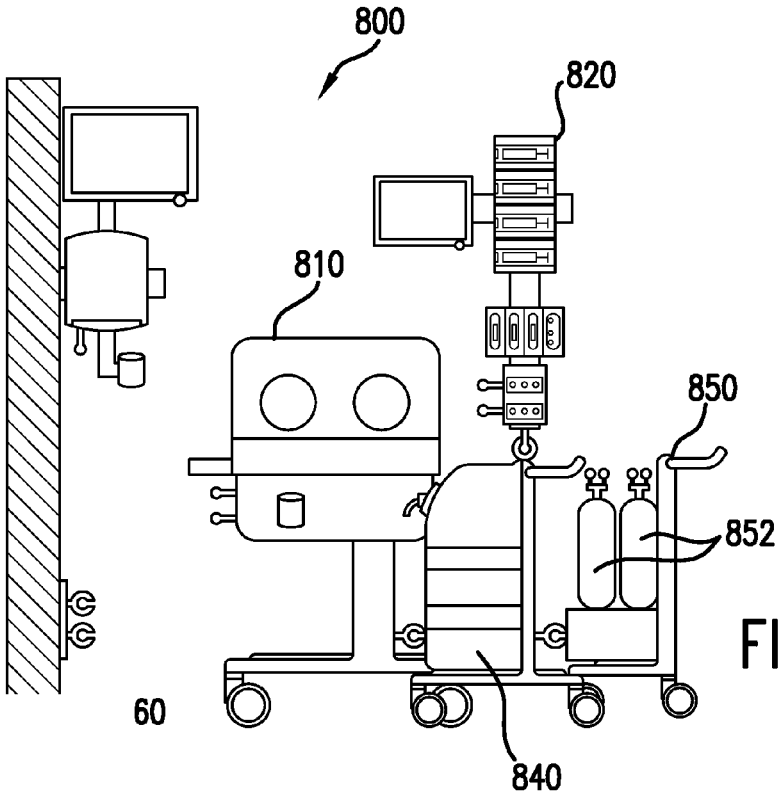
FIG. 24*c* shows the eighth exemplary embodiment of an infant care system with a monitor and frame system, a ventilator cart and ventilation gas tanks transportably mounted on the warming therapy device.

FIGS. 24*a*-24*c* show the eighth exemplary embodiment of an infant care system 800 with a wall mounted monitor and frame system 820 and a ventilator cart 840 docked to a warming therapy device 810. In FIG. 24*a*, the monitor and frame system 820 is mounted on the wall 860. The warming therapy device 810 is docked to the wall 860 and the monitor and frame system 820 via docking cables 862. A ventilator cart 840 is docked directly to the warming therapy device 810.

FIG. 24*b* shows the infant care system 800 with a monitor and frame system 820 and ventilator cart 840 docked thereto. The warming therapy device 810 is docked to the wall 860 via a docking cable 862.

FIG. 24*c* shows the infant care system 800 with a warming therapy device 810 having a monitor and frame system 820 and a ventilator cart 840 docked thereto. The warming therapy device 810 is not docked to the wall 860 and supply cart 850 having gas tanks 852 and a battery 854 is docked to the ventilation cart 840. When detached from the wall 860, the infant care system 800 is movable as a self-contained unit with various devices docked together.

Figure 25A:
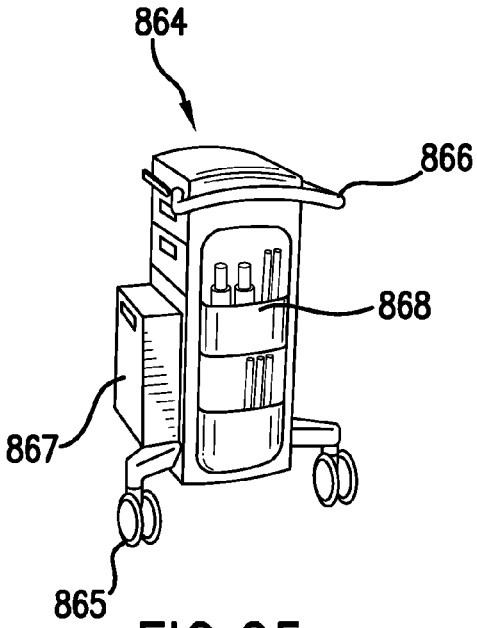
FIG. 25*a* shows a storage cart for use in connection with an infant care system.

FIG. 25*a* shows a storage cart 864 for use in connection with an infant care system, such as the infant care system 100 described above. The storage cart 864 is dockable to the warming therapy device 110 of the infant care system 100, for rolling transport therewith. The storage cart 864 includes wheels 865 and a handle 866 for moving the infant care system 100. The storage cart 864 may also include drawers 867 and shelving 868 for carrying any necessary supplies for treating the infant in the warming therapy device 110.

Figure 25B:
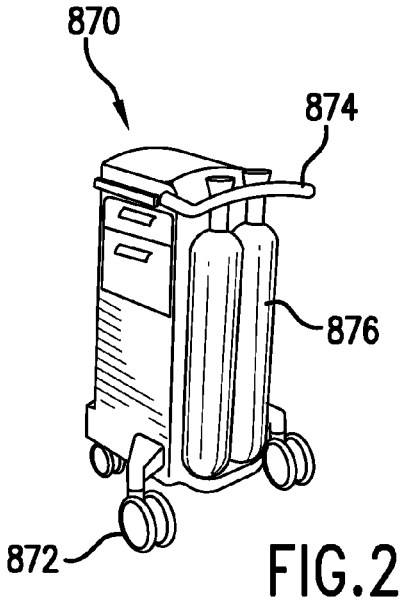
FIG. 25*b* shows a transport cant for use in connection with an infant care system.

FIG. 25*b* shows a transport cart 870 for use in connection with an infant care system, such as the infant care system 100. The transport cart 870 is dockable to the warming therapy device 110 of the infant care system 100, far rolling transport therewith. The transport cart 870 includes wheels 872 and a handle 874 for moving the infant care system 100. The transport can 870 also includes gas tanks 876 for providing uninterrupted ventilation gas or excess oxygen during transport. Drawers, a battery or other apparatus may also be mounted on the transport cart 870.

Figure 25C:
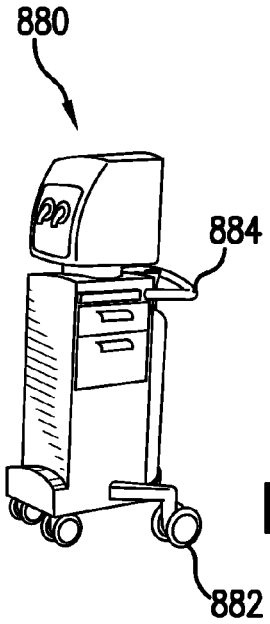
FIG. 25*c* shows a ventilator cart for use in connection with an infant care system.

FIG. 25*c* shows a ventilator cart 880 for use in connection with an infant care system, such as the infant care system 100. The ventilator cart 880 is dockable to the warming therapy device 110 of the infant care system 100, for rolling transport therewith. The ventilator cart 880 includes wheels 882 and a handle 884 for moving the infant care system 100. The ventilator cart 880 is adapted to provide ventilation treatment to an infant in the warming therapy device 110 and may be supplied with ventilation gas by a permanent source or a transportable source, such as the gas tanks 876 mounted on the transport cart 870 of FIG. 25*b*.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

An apparatus as described above with reference to the foregoing description and appended drawings is hereby claimed.

What is claimed is:

1. A modular infant care system comprising:

a warming therapy device including a plurality of wheels and a patient support surface; and a peripheral device comprising at least two wheels and being adapted for releasably engaging the warming therapy device proximate the patient support surface, wherein when the warming therapy device and the peripheral device are engaged to each other, the infant care system is movable as a combined unit with one of the at least two wheels of the peripheral device being raised up when the warming therapy device and the peripheral device are engaged and the other of the at least two wheels remaining in the same position as prior to the engagement, wherein the warming therapy device comprises an incubator.

2. The modular infant care system according to claim 1, wherein the peripheral device is raised with the patient support surface when the patient support surface is raised.

3. The modular infant care system according to claim 1, wherein at least one of the warming therapy device or the peripheral device is adapted for releasably engaging a second peripheral device.

4. The modular infant care system according to claim 1, wherein the warming therapy device comprises first and second longitudinal ends and the peripheral device engages one of the first or second longitudinal ends of the warming therapy device.

5. The modular infant care system according to claim 1, wherein the peripheral device comprises at least one of a ventilator, a monitor, a compressor, refrigerated storage, heated storage, a water mattress, a cooling system, a heating system or a surgical cart.

6. The modular infant care system according to claim 1, wherein one of the at least two wheels of the peripheral device is retracted prior to moving the infant care system as a combined unit.

7. A modular infant care system comprising:

a warming therapy device including a plurality of wheels and a patient support surface having an adjustable height; and a peripheral device comprising at least two wheels and being adapted for releasably engaging the warming therapy device proximate the patient support surface, wherein when the warming therapy device and the peripheral device are engaged to each other, the infant care system is movable as a combined unit with one of the at least two wheels of the peripheral device being raised up when the warming therapy device and the peripheral device are engaged and the other of the at least two wheels remaining in the same position as prior to the engagement, wherein the warming therapy device comprises an incubator, and wherein the warming therapy device includes a braking system and braking controls and the peripheral device includes a braking system and the braking controls of the warming therapy device are operable to control the braking systems of both the warming therapy and the peripheral devices when the peripheral device is engaged with the warming therapy device.

8. An apparatus comprising:

a first medical device having a patient support surface, a braking system, braking controls and a plurality of wheels; and a second medical device adapted for engaging the first medical device and having a braking system and at least two wheels, wherein the first medical device comprises an incubator, wherein one of the at least two wheels of the second medical device is raised up when the first medical device and the second medical device are engaged and another of the at least two wheels remains in the same position as prior to the engagement, wherein when the second medical device is engaged to the first medical device, the first and second medical devices are transportable as a combined unit, and wherein the second medical device includes a braking system and the braking controls of the first medical device are operable to control the braking systems of both the first and second medical devices when the second medical device is engaged with the first medical device.

9. The apparatus according to claim 8, wherein the second medical device comprises at least one of a ventilator, a monitor, a compressor, refrigerated storage, heated storage, a water mattress, a cooling system, a heating system or a surgical cart.

10. The apparatus according to claim 8, wherein the first medical device and the second medical device each comprise a docking port.

11. The apparatus according to claim 10, wherein the docking port has at least one of a power connection, a ventilation gas connection, a monitor connection or a control connection.

12. The apparatus according to claim 8, wherein at least one of the first medical device or the second medical device comprise a power source for providing power to at least one of the first or second medical devices.

13. The apparatus according to claim 8, wherein the at least two wheels of the second medical device are adapted for rolling engagement with a supporting surface and, when the second medical device is engaged with the first medical device, at least one of the at least two wheels of the second medical device is raised above the supporting surface.

14. The apparatus according to claim 8, wherein the plurality of wheels of the first medical device are adapted for rolling engagement with a supporting surface and the at least two wheels of the second medical device are adapted for rolling engagement with the supporting surface and, when the second medical device is engaged with the first medical device, at least one of the at least two wheels of the second medical device remain at a level for rolling engagement with the supporting surface.

15. The apparatus according to claim 8, the apparatus further comprising a docking cable for connecting the first and second medical devices together.

16. A method for transporting a patient comprising:

providing a first medical device adapted for holding a patient in a controlled environment, the medical device having a plurality of wheels for engaging a supporting surface;

providing a second medical device having at least two wheels for engaging the supporting surface and the second medical device being adapted to releasably engage the first medical device;

engaging the first medical device to the second medical device;

raising the second medical device above the supporting surface; and moving the first medical device and second medical device in unison, wherein the first medical device comprises an incubator, and wherein the step of raising the second medical device above the supporting surface comprises moving a first wheel of the at least two wheels of the second medical device away from the supporting surface, while leaving a second wheel of the at least two wheels of the second medical device in contact with the supporting surface.

17. The method according to claim 16, wherein the second medical device comprises at least one of a ventilator, a monitor, a compressor, refrigerated storage, heated storage, a water mattress, a cooling system, a heating system or a surgical cart.

18. The method according to claim 16, further comprising the steps of providing a third medical device and engaging the third medical device to at least one of the first or second medical devices.

19. The method according to claim 16, wherein the first medical device comprises a patient support surface and wherein the step of engaging the first medical device and the second medical device comprises engaging the second medical device to a portion of the first medical device proximate the patient support surface.

20. The method according to claim 19, further comprising the step of raising the patient support surface, thereby lifting one of the at least two wheels of the second medical device above the supporting surface.

21. The method according to claim 16, wherein the step of raising the second medical device above the supporting surface further comprises retracting the first of the at least two wheels of the second medical device.

22. An apparatus comprising:

a first medical device having a patient support surface, a plurality of wheels and a first docking port located proximate the patient support surface;

a second medical device having at least two wheels and a second docking port adapted for mating to the first docking port, wherein when the second medical device is mated to the first medical device, the first and second medical devices are transportable as a combined unit, wherein the first medical device comprises an incubator, and wherein one of the at least two wheels of the second medical device is raised up when the first medical device and the second medical device are mated and another of the at least two wheels remains in the same position as prior to the mating.

23. The apparatus according to claim 22, wherein a height of the patient support surface is adjustable.

24. The apparatus according to claim 22, wherein the second medical device is raised and lowered with the patient support surface when the second docking port is engaged to the first docking port.

25. The apparatus according to claim 22, wherein one of the at least two wheels of the second medical device is retracted prior to transporting the first and second medical devices as a combined unit.

* * * * *